US009162498B2

(12) United States Patent
Yamaguchi et al.

(10) Patent No.: US 9,162,498 B2
(45) Date of Patent: Oct. 20, 2015

(54) INK JET PRINTING APPARATUS AND IMAGE PROCESSING APPARATUS

(71) Applicant: CANON KABUSHIKI KAISHA, Tokyo (JP)

(72) Inventors: Hiromitsu Yamaguchi, Yokohama (JP); Yoshitomo Marumoto, Kawasaki (JP); Hitoshi Tsuboi, Kawasaki (JP); Ryota Kato, Yokohama (JP); Takayuki Ushiyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/564,537

(22) Filed: Dec. 9, 2014

(65) Prior Publication Data

US 2015/0174930 A1 Jun. 25, 2015

(30) Foreign Application Priority Data

Dec. 24, 2013 (JP) ..... 2013-265352

(51) Int. Cl.
*B41J 29/393* (2006.01)
*B41J 13/00* (2006.01)

(52) U.S. Cl.
CPC ..... *B41J 13/0009* (2013.01)

(58) Field of Classification Search
CPC ..... B41J 11/46; B41J 11/0095; B41J 11/007; B41J 13/0009; B41J 2/04541; B41J 11/42
See application file for complete search history.

(56) References Cited

U.S. PATENT DOCUMENTS

| | | | | |
|---|---|---|---|---|
| 7,438,374 | B2 | 10/2008 | Shibata et al. | |
| 7,950,766 | B2 * | 5/2011 | Ejiri et al. | 347/19 |
| 8,007,070 | B2 * | 8/2011 | Kaga et al. | 347/23 |
| 8,434,846 | B2 * | 5/2013 | Tanaka | 347/14 |
| 8,926,054 | B2 * | 1/2015 | Emoto et al. | 347/19 |

FOREIGN PATENT DOCUMENTS

| | | | |
|---|---|---|---|
| JP | 08-025693 | A | 1/1996 |
| JP | 2002-36524 | A | 2/2002 |
| JP | 2008-000922 | A | 1/2008 |

OTHER PUBLICATIONS

U.S. Appl. No. 14/564,449, filed Dec. 9, 2014.
U.S. Appl. No. 14/564,442, filed Dec. 9, 2014.

* cited by examiner

*Primary Examiner* — Lamson Nguyen
(74) *Attorney, Agent, or Firm* — Fitzpatrick, Cella, Harper & Scinto

(57) ABSTRACT

An ink jet printing apparatus and an image processing apparatus capable of stably outputting an image with no joint streak even in the case where printing conditions, such as the kind of ink and the kind of printing medium, change in a variety of ways are provided. For this purpose, correction processing is performed on image data corresponding to an eject port group located at one end part of an eject port column in a first printing scan and on image data corresponding to an eject port group located at the other end part in a second printing scan. At this time, the number of eject ports included in a first eject port group and the number of eject ports included in a second eject port group are adjusted in accordance with printing conditions.

23 Claims, 27 Drawing Sheets

| | | | | | | | | | | | | | | | |
|---|---|---|---|---|---|---|---|---|---|---|---|---|---|---|---|
| IV | II | IV | II | IV | II | IV | II | IV | II | IV | II | IV | II | IV | II |
| II | IV | II | IV | II | IV | II | IV | II | IV | II | IV | II | IV | II | IV |
| IV | II | IV | II | IV | II | IV | II | IV | II | IV | II | IV | II | IV | II |
| II | I | II | I | II | I | II | I | II | I | II | I | II | I | II | I |
| I | II | I | II | I | II | I | II | I | II | I | II | I | II | I | II |
| IV | I | IV | I | IV | I | IV | I | IV | I | IV | I | IV | I | IV | I |
| I | IV | I | IV | I | IV | I | IV | I | IV | I | IV | I | IV | I | IV |
| IV | I | IV | I | IV | I | IV | I | IV | I | IV | I | IV | I | IV | I |

BOUNDARY PART
CORRECTION WIDTH
CORRECTION WIDTH

PATTERN SELECTION TABLE D

| | | | | | | | | | | | | | | | |
|---|---|---|---|---|---|---|---|---|---|---|---|---|---|---|---|
| I | III | I | III | I | III | I | III | I | III | I | III | I | III | I | III |
| III | I | III | I | III | I | III | I | III | I | III | I | III | I | III | I |
| I | III | I | III | I | III | I | III | I | III | I | III | I | III | I | III |
| II | I | II | I | II | I | II | I | II | I | II | I | II | I | II | I |
| I | II | I | II | I | II | I | II | I | II | I | II | I | II | I | II |
| II | III | II | III | II | III | II | III | II | III | II | III | II | III | II | III |
| III | II | III | II | III | II | III | II | III | II | III | II | III | II | III | II |
| II | III | II | III | II | III | II | III | II | III | II | III | II | III | II | III |

BOUNDARY PART
CORRECTION WIDTH
CORRECTION WIDTH

PATTERN SELECTION TABLE E

PATTERN SELECTION TABLE A

PATTERN SELECTION TABLE B

| | | | | | | | | | | | | | | | |
|---|---|---|---|---|---|---|---|---|---|---|---|---|---|---|---|
| 1 | 9 | 5 | 13 | 3 | 11 | 7 | 15 | 2 | 10 | 6 | 14 | 4 | 12 | 8 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 1 | 9 | 5 | 13 | 3 | 11 | 7 | 15 | 2 | 10 | 6 | 14 | 4 | 12 | 8 | 16 |

TABLE SETTING MATRIX α

FIG.8

| EVALUATION VALUE | DENSITY INCREASE/ DECREASE PARAMETER |
|---|---|
| 255 | 0 |
| 239 | 1 |
| 223 | 2 |
| 207 | 3 |
| 191 | 4 |
| 175 | 5 |
| 159 | 6 |
| 143 | 7 |
| 127 | 8 |
| 111 | 9 |
| 95 | 10 |
| 79 | 11 |
| 63 | 12 |
| 47 | 13 |
| 31 | 14 |
| 15 | 15 |
| 0 | 16 |

FIG.9

| | | | | | | | | | | | | | | | |
|---|---|---|---|---|---|---|---|---|---|---|---|---|---|---|---|
| IV | II | IV | II | IV | II | IV | II | IV | II | IV | II | IV | II | IV | II |
| II | IV | II | IV | II | IV | II | IV | II | IV | II | IV | II | IV | II | IV |
| IV | II | IV | II | IV | II | IV | II | IV | II | IV | II | IV | II | IV | II |
| II | I | II | I | II | I | II | I | II | I | II | I | II | I | II | I |
| I | II | I | II | I | II | I | II | I | II | I | II | I | II | I | II |
| IV | I | IV | I | IV | I | IV | I | IV | I | IV | I | IV | I | IV | I |
| I | IV | I | IV | I | IV | I | IV | I | IV | I | IV | I | IV | I | IV |
| IV | I | IV | I | IV | I | IV | I | IV | I | IV | I | IV | I | IV | I |

BOUNDARY PART

CORRECTION WIDTH

CORRECTION WIDTH

PATTERN SELECTION TABLE D

FIG.11A

| | | | | | | | | | | | | | | | |
|---|---|---|---|---|---|---|---|---|---|---|---|---|---|---|---|
| I | III | I | III | I | III | I | III | I | III | I | III | I | III | I | III |
| III | I | III | I | III | I | III | I | III | I | III | I | III | I | III | I |
| I | III | I | III | I | III | I | III | I | III | I | III | I | III | I | III |
| II | I | II | I | II | I | II | I | II | I | II | I | II | I | II | I |
| I | II | I | II | I | II | I | II | I | II | I | II | I | II | I | II |
| II | III | II | III | II | III | II | III | II | III | II | III | II | III | II | III |
| III | II | III | II | III | II | III | II | III | II | III | II | III | II | III | II |
| II | III | II | III | II | III | II | III | II | III | II | III | II | III | II | III |

BOUNDARY PART

CORRECTION WIDTH

CORRECTION WIDTH

PATTERN SELECTION TABLE E

FIG.11B

| | | | | | | | | | | | | | | | |
|---|---|---|---|---|---|---|---|---|---|---|---|---|---|---|---|
| 1 | 9 | 5 | 13 | 3 | 11 | 7 | 15 | 2 | 10 | 6 | 14 | 4 | 12 | 8 | 16 |
| 12 | 8 | 16 | 1 | 9 | 5 | 13 | 3 | 11 | 7 | 15 | 2 | 10 | 6 | 14 | 4 |
| 6 | 14 | 4 | 12 | 8 | 16 | 1 | 9 | 5 | 13 | 3 | 11 | 7 | 15 | 2 | 10 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 6 | 14 | 4 | 12 | 8 | 16 | 1 | 9 | 5 | 13 | 3 | 11 | 7 | 15 | 2 | 10 |
| 12 | 8 | 16 | 1 | 9 | 5 | 13 | 3 | 11 | 7 | 15 | 2 | 10 | 6 | 14 | 4 |
| 1 | 9 | 5 | 13 | 3 | 11 | 7 | 15 | 2 | 10 | 6 | 14 | 4 | 12 | 8 | 16 |

BOUNDARY PART

TABLE SETTING MATRIX β

FIG.11C

| | | | | | | | | | | | | | | | |
|---|---|---|---|---|---|---|---|---|---|---|---|---|---|---|---|
| IV | II | IV | II | IV | II | IV | II | IV | II | IV | II | IV | II | IV | II |
| II | IV | II | IV | II | IV | II | IV | II | IV | II | IV | II | IV | II | IV |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | IV | I | IV | I | IV | I | IV | I | IV | I | IV | I | IV | I | IV |
| IV | I | IV | I | IV | I | IV | I | IV | I | IV | I | IV | I | IV | I |

BOUNDARY PART CORRECTION WIDTH

CORRECTION WIDTH

PATTERN SELECTION TABLE F

FIG.14A

| | | | | | | | | | | | | | | | |
|---|---|---|---|---|---|---|---|---|---|---|---|---|---|---|---|
| I | III | I | III | I | III | I | III | I | III | I | III | I | III | I | III |
| III | I | III | I | III | I | III | I | III | I | III | I | III | I | III | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| III | II | III | II | III | II | III | II | III | II | III | II | III | II | III | II |
| II | III | II | III | II | III | II | III | II | III | II | III | II | III | II | III |

BOUNDARY PART CORRECTION WIDTH

CORRECTION WIDTH

PATTERN SELECTION TABLE G

FIG.14B

| | | | | | | | | | | | | | | | |
|---|---|---|---|---|---|---|---|---|---|---|---|---|---|---|---|
| 1 | 9 | 5 | 13 | 3 | 11 | 7 | 15 | 2 | 10 | 6 | 14 | 4 | 12 | 8 | 16 |
| 12 | 8 | 16 | 1 | 9 | 5 | 13 | 3 | 11 | 7 | 15 | 2 | 10 | 6 | 14 | 4 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 12 | 8 | 16 | 1 | 9 | 5 | 13 | 3 | 11 | 7 | 15 | 2 | 10 | 6 | 14 | 4 |
| 1 | 9 | 5 | 13 | 3 | 11 | 7 | 15 | 2 | 10 | 6 | 14 | 4 | 12 | 8 | 16 |

BOUNDARY PART

TABLE SETTING MATRIX γ

FIG.14C

| | | | | | | | | | | | | | | | |
|---|---|---|---|---|---|---|---|---|---|---|---|---|---|---|---|
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |

PATTERN SELECTION TABLE A'

FIG.16A

| | | | | | | | | | | | | | | | |
|---|---|---|---|---|---|---|---|---|---|---|---|---|---|---|---|
| III | IV | III | IV | III | IV | III | IV | III | IV | III | IV | III | IV | III | IV |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| IV | III | IV | III | IV | III | IV | III | IV | III | IV | III | IV | III | IV | III |

PATTERN SELECTION TABLE B'

FIG.16B

| | | | | | | | | | | | | | | | |
|---|---|---|---|---|---|---|---|---|---|---|---|---|---|---|---|
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| IV | I | IV | I | IV | I | IV | I | IV | I | IV | I | IV | I | IV | I |

CORRECTION WIDTH

BOUNDARY PART

FIG.20A PATTERN SELECTION TABLE H

| | | | | | | | | | | | | | | | |
|---|---|---|---|---|---|---|---|---|---|---|---|---|---|---|---|
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | III | II | III | II | III | II | III | II | III | II | III | II | III | II | III |

CORRECTION WIDTH

BOUNDARY PART

FIG.20B PATTERN SELECTION TABLE I

| | | | | | | | | | | | | | | | |
|---|---|---|---|---|---|---|---|---|---|---|---|---|---|---|---|
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 1 | 9 | 5 | 13 | 3 | 11 | 7 | 15 | 2 | 10 | 6 | 14 | 4 | 12 | 8 | 16 |

BOUNDARY PART

FIG.20C TABLE SETTING MATRIX δ

| | | | | | | | | | | | | | | | |
|---|---|---|---|---|---|---|---|---|---|---|---|---|---|---|---|
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| IV | I | IV | I | IV | I | IV | I | IV | I | IV | I | IV | I | IV | I |
| I | IV | I | IV | I | IV | I | IV | I | IV | I | IV | I | IV | I | IV |
| IV | I | IV | I | IV | I | IV | I | IV | I | IV | I | IV | I | IV | I |

CORRECTION WIDTH

BOUNDARY PART

FIG.20D PATTERN SELECTION TABLE J

| | | | | | | | | | | | | | | | |
|---|---|---|---|---|---|---|---|---|---|---|---|---|---|---|---|
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | III | II | III | II | III | II | III | II | III | II | III | II | III | II | III |
| III | II | III | II | III | II | III | II | III | II | III | II | III | II | III | II |
| II | III | II | III | II | III | II | III | II | III | II | III | II | III | II | III |

CORRECTION WIDTH

BOUNDARY PART

FIG.20E PATTERN SELECTION TABLE K

| | | | | | | | | | | | | | | | |
|---|---|---|---|---|---|---|---|---|---|---|---|---|---|---|---|
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 6 | 14 | 4 | 12 | 8 | 16 | 1 | 9 | 5 | 13 | 3 | 11 | 7 | 15 | 2 | 10 |
| 12 | 8 | 16 | 1 | 9 | 5 | 13 | 3 | 11 | 7 | 15 | 2 | 10 | 6 | 14 | 4 |
| 1 | 9 | 5 | 13 | 3 | 11 | 7 | 15 | 2 | 10 | 6 | 14 | 4 | 12 | 8 | 16 |

BOUNDARY PART

FIG.20F TABLE SETTING MATRIX ε

| | | | | | | | | | | | | | | | |
|---|---|---|---|---|---|---|---|---|---|---|---|---|---|---|---|
| IV | II | IV | II | IV | II | IV | II | IV | II | IV | II | IV | II | IV | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |

BOUNDARY PART

CORRECTION WIDTH

FIG.21A PATTERN SELECTION TABLE H

| | | | | | | | | | | | | | | | |
|---|---|---|---|---|---|---|---|---|---|---|---|---|---|---|---|
| I | III | I | III | I | III | I | III | I | III | I | III | I | III | I | III |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |

BOUNDARY PART

CORRECTION WIDTH

FIG.21B PATTERN SELECTION TABLE I

| | | | | | | | | | | | | | | | |
|---|---|---|---|---|---|---|---|---|---|---|---|---|---|---|---|
| 1 | 9 | 5 | 13 | 3 | 11 | 7 | 15 | 2 | 10 | 6 | 14 | 4 | 12 | 8 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |

BOUNDARY PART

FIG.21C TABLE SETTING MATRIX δ′

| | | | | | | | | | | | | | | | |
|---|---|---|---|---|---|---|---|---|---|---|---|---|---|---|---|
| IV | II | IV | II | IV | II | IV | II | IV | II | IV | II | IV | II | IV | II |
| II | IV | II | IV | II | IV | II | IV | II | IV | II | IV | II | IV | II | IV |
| IV | II | IV | II | IV | II | IV | II | IV | II | IV | II | IV | II | IV | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |

BOUNDARY PART

CORRECTION WIDTH

FIG.21D PATTERN SELECTION TABLE J

| | | | | | | | | | | | | | | | |
|---|---|---|---|---|---|---|---|---|---|---|---|---|---|---|---|
| I | III | I | III | I | III | I | III | I | III | I | III | I | III | I | III |
| III | I | III | I | III | I | III | I | III | I | III | I | III | I | III | I |
| I | III | I | III | I | III | I | III | I | III | I | III | I | III | I | III |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |

BOUNDARY PART

CORRECTION WIDTH

FIG.21E PATTERN SELECTION TABLE K

| | | | | | | | | | | | | | | | |
|---|---|---|---|---|---|---|---|---|---|---|---|---|---|---|---|
| 1 | 9 | 5 | 13 | 3 | 11 | 7 | 15 | 2 | 10 | 6 | 14 | 4 | 12 | 8 | 16 |
| 12 | 8 | 16 | 1 | 9 | 5 | 13 | 3 | 11 | 7 | 15 | 2 | 10 | 6 | 14 | 4 |
| 6 | 14 | 4 | 12 | 8 | 16 | 1 | 9 | 5 | 13 | 3 | 11 | 7 | 15 | 2 | 10 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |

BOUNDARY PART

FIG.21F TABLE SETTING MATRIX ε′

| | | | | | | | | | | | | | | | |
|---|---|---|---|---|---|---|---|---|---|---|---|---|---|---|---|
| 1 | 9 | 5 | 13 | 3 | 11 | 7 | 15 | 4 | 12 | 8 | 16 | 1 | 9 | 5 | 13 |
| 5 | 13 | 3 | 11 | 7 | 15 | 2 | 10 | 2 | 10 | 6 | 14 | 4 | 12 | 8 | 16 |
| 3 | 11 | 7 | 15 | 2 | 10 | 6 | 14 | 6 | 14 | 4 | 12 | 8 | 16 | 1 | 9 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 3 | 11 | 7 | 15 | 2 | 10 | 6 | 14 | 6 | 14 | 4 | 12 | 8 | 16 | 1 | 9 |
| 5 | 13 | 3 | 11 | 7 | 15 | 2 | 10 | 2 | 10 | 6 | 14 | 4 | 12 | 8 | 16 |
| 1 | 9 | 5 | 13 | 3 | 11 | 7 | 15 | 4 | 12 | 8 | 16 | 1 | 9 | 5 | 13 |

TABLE SETTING MATRIX

FIG.22

| | | | | | | | | | | | | | | | |
|---|---|---|---|---|---|---|---|---|---|---|---|---|---|---|---|
| IV | II | IV | II | IV | II | IV | II | IV | II | IV | II | IV | II | IV | II |
| II | IV | II | IV | II | IV | II | IV | II | IV | II | IV | II | IV | II | IV |
| IV | II | IV | II | IV | II | IV | II | IV | II | IV | II | IV | II | IV | II |
| II | I | II | I | II | I | II | I | II | I | II | I | II | I | II | I |
| I | II | I | II | I | II | I | II | I | II | I | II | I | II | I | II |
| IV | I | IV | I | IV | I | IV | I | IV | I | IV | I | IV | I | IV | I |
| I | IV | I | IV | I | IV | I | IV | I | IV | I | IV | I | IV | I | IV |
| IV | I | IV | I | IV | I | IV | I | IV | I | IV | I | IV | I | IV | I |

PATTERN SELECTION TABLE D

| | | | | | | | | | | | | | | | |
|---|---|---|---|---|---|---|---|---|---|---|---|---|---|---|---|
| I | III | I | III | I | III | I | III | I | III | I | III | I | III | I | III |
| III | I | III | I | III | I | III | I | III | I | III | I | III | I | III | I |
| I | III | I | III | I | III | I | III | I | III | I | III | I | III | I | III |
| II | I | II | I | II | I | II | I | II | I | II | I | II | I | II | I |
| I | II | I | II | I | II | I | II | I | II | I | II | I | II | I | II |
| II | III | II | III | II | III | II | III | II | III | II | III | II | III | II | III |
| III | II | III | II | III | II | III | II | III | II | III | II | III | II | III | II |
| II | III | II | III | II | III | II | III | II | III | II | III | II | III | II | III |

PATTERN SELECTION TABLE E (DENSITY INCREASE/
DECREASE PARAMETER) = 8

| | | | | | | | | | | | | | | | |
|---|---|---|---|---|---|---|---|---|---|---|---|---|---|---|---|
| 1 | 9 | 5 | 13 | 3 | 11 | 7 | 15 | 2 | 10 | 6 | 14 | 4 | 12 | 8 | 16 |
| 12 | 8 | 16 | 1 | 9 | 5 | 13 | 3 | 11 | 7 | 15 | 2 | 10 | 6 | 14 | 4 |
| 6 | 14 | 4 | 12 | 8 | 16 | 1 | 9 | 5 | 13 | 3 | 11 | 7 | 15 | 2 | 10 |
| 16 | 16 | 16 | 16 | 16 | 16 | 16 | 16 | 16 | 16 | 16 | 16 | 16 | 16 | 16 | 16 |
| 16 | 16 | 16 | 16 | 16 | 16 | 16 | 16 | 16 | 16 | 16 | 16 | 16 | 16 | 16 | 16 |
| 6 | 14 | 4 | 12 | 8 | 16 | 1 | 9 | 5 | 13 | 3 | 11 | 7 | 15 | 2 | 10 |
| 12 | 8 | 16 | 1 | 9 | 5 | 13 | 3 | 11 | 7 | 15 | 2 | 10 | 6 | 14 | 4 |
| 1 | 9 | 5 | 13 | 3 | 11 | 7 | 15 | 2 | 10 | 6 | 14 | 4 | 12 | 8 | 16 |

TABLE SETTING MATRIX β

| | | | | | | | | | | | | | | | |
|---|---|---|---|---|---|---|---|---|---|---|---|---|---|---|---|
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |
| I | II | I | II | I | II | I | II | I | II | I | II | I | II | I | II |
| II | I | II | I | II | I | II | I | II | I | II | I | II | I | II | I |

PATTERN TABLE Z

FIG.23A

INK JET PRINTING APPARATUS AND IMAGE PROCESSING APPARATUS

BACKGROUND OF THE INVENTION

1. Field of the Invention

The present invention relates to an ink jet printing apparatus and an image processing apparatus.

2. Description of the Related Art

In a serial type ink jet printing apparatus, a printing scan in which a printing head is moved while causing the printing head to eject ink in accordance with image data and a conveyance operation to convey a printing medium in a direction intersecting the direction of the printing scan are repeated alternately. At this time, there is a case where a joint streak occurs at the boundary part between the regions in which printing is performed by printing scans performed twice successively in the printing medium.

For example, Japanese Patent Laid-Open No. H08-25693 (1996) has disclosed the method for causing printing regions in which printing scans are performed twice successively to overlap each other to a certain extent in the conveyance direction and adjusting the number of dots that are printed in the overlapped region by using a mask pattern. At this time, by using a gradation mask pattern by which the printing ratio at end parts of the printing head is reduced gradually, it is possible to suppress unevenness in density in each overlapped region.

Further, Japanese Patent Laid-Open No. 2002-36524 has disclosed the method for counting the number of dots that are printed in the vicinity of the boundary part and adjusting the thinning ratio at the boundary part in accordance with the number of counted dots without providing an overlapped region. Conspicuity of the joint streak depends on the gradations, i.e., the number of dots that are printed, but by adopting Japanese Patent Laid-Open No. 2002-36524, it is possible to appropriately adjust the number of dots at the boundary part in accordance with the gradations, and therefore, it is made possible to make less conspicuous the joint streak regardless of the density. On the other hand, Japanese Patent Laid-Open No. 2008-922 has disclosed a method for adding dots at the joint part region by focusing on, in particular, a white streak.

However, in the case where Japanese Patent Laid-Open No. H08-25693 (1996) is adopted, the number of times of printing scan required to print an image is different between the overlapped region and the other region. Specifically, in the case of the one-pass printing, in the overlapped region, ink is given during the printing scans performed twice, but in the other region, ink is given during the printing scan performed once. As a result of that, for example, in the case where printing is performed on glossy paper by using, for example, a pigment ink, there is produced a difference in the degree of irregularities of the image surface, i.e., smoothness between the overlapped region and the other region, and the difference may be erroneously recognized as glossiness unevenness. Further, in the case where mixed-color printing is performed by using inks in two or more colors, there is produced a difference in the color tone and saturation between the overlapped region and the other region and the difference may be erroneously recognized as color unevenness.

According to the intensive examination by the inventors etc., of the present invention, even in the case where Japanese Patent Laid-Open No. 2002-36524 was adopted and the thinning ratio at the boundary region was adjusted in accordance with the gradation without providing the overlapped region, it was recognized that the joint streak was not reduced sufficiently or the joint streak was made more conspicuous on the contrary. The reason the joint streak was not reduced sufficiently is that conventionally, the number of dots was adjusted only in specific regions adjacent to the boundary part despite the fact that the range in which the joint streak appears (thickness of the joint streak) varies depending on a variety of conditions, such as the kind of ink, printing medium, etc.

SUMMARY OF THE INVENTION

The present invention has been made in order to solve the above-described problems. Consequently, an object thereof is to provide an ink jet printing apparatus and an image processing apparatus capable of stably outputting an image with no joint streak even in the case where the printing conditions, such as the kind of ink and the kind of printing medium, vary in a variety of ways.

In a first aspect of the present invention, there is provided an ink jet printing apparatus that prints an image on a printing medium by repeating a printing scan in which an eject port column in which a plurality of eject ports for ejecting ink in accordance with image data is arrayed is moved with respect to the printing medium and a conveyance operation to convey the printing medium in a direction intersecting the direction of the printing scan, the ink jet printing apparatus comprising: a conveyance control unit configured to control the conveyance operation so that a position where printing is performed by an eject port located at one end part of the eject port column in a first printing scan and a position where printing is performed by an eject port located at the other end part of the eject port column in a second printing scan are adjacent to each other in the direction of the conveyance on the printing medium; and a correction unit configured to perform correction processing for increasing or decreasing the number of times of ink eject for image data corresponding to a first eject port group consisting of a plurality of successive eject ports including the eject port located at the one end part in the first printing scan and for image data corresponding to a second eject port group consisting of a plurality of successive eject ports including the eject port located at the other end part in the second printing scan, wherein the correction unit sets the number of eject ports included in the first eject port group and the number of eject ports included in the second eject port group in accordance with a set printing condition.

In a second aspect of the present invention, there is provided an image processing apparatus that performs processing on multivalued image data corresponding to a unit region for printing an image in the unit region including a plurality of pixel regions on a printing medium by a plurality of scans of a an eject port column in which a plurality of eject ports for ejecting ink are arrayed in a predetermined direction with respect to the printing medium, wherein the plurality of eject ports ejects ink to each of the plurality of pixel regions on the printing medium in accordance with dot printing data corresponding to each of the plurality of scans, and by conveying the printing medium between the plurality of scans, the image processing apparatus comprising: a first acquisition unit configured to acquire information on printing conditions; a second acquisition unit configured to acquire information on a density of an image that is printed in the pixel region; a third acquisition unit configured to acquire N (≥3)-valued quantized data corresponding to the pixel region based on the image data; a fourth acquisition unit configured to acquire a plurality of dot arrangement pattern groups including at least a first dot arrangement pattern group including a plurality of first dot arrangement patterns in which an arrangement of dots is determined so that the number and position of dots that are printed within the pixel region are different in accordance with a value of the N-valued quantized data and a second dot arrangement pattern group including a plurality of second dot arrangement patterns in which an arrangement of dots is determined so that the number and position of dots that are printed within the pixel region are different in accordance with a value of the N-valued quantized data; a setting unit configured to set one dot arrangement pattern group from the plurality of dot arrangement pattern groups acquired by the fourth acquisition unit in accordance with the positions of the plurality of pixel regions within the unit region; and a generation unit configured to generate the dot printing data based on the N-valued quantized data acquired by the third acquisition unit and the dot arrangement pattern group set by the setting unit, wherein the number of dots that are printed within the pixel region determined by the second dot arrangement pattern corresponding to the N-valued quantized data having a predetermined value is smaller than the number of dots that are printed within the pixel region determined by the first dot arrangement pattern corresponding to the N-valued quantized data having the predetermined value, and the setting unit sets the dot arrangement pattern group so that: (i) the number of the second dot arrangement pattern groups determined for the plurality of pixel regions located in an end part region corresponding to an end part of the eject port column in the predetermined direction within the unit region in a case where a printing condition indicated by the information acquired by the first acquisition unit is a first printing condition and the density of the image indicated by the information acquired by the second acquisition unit is a first value is smaller than the number of the second dot arrangement pattern groups determined for the plurality of pixel regions located in the end part region in a case where a printing condition indicated by the information acquired by the first acquisition unit is the first printing condition and the density of the image indicated by the information acquired by the second acquisition unit is a second value lower than the first value; (ii) the number of the second dot arrangement pattern groups determined for the plurality of pixel regions located in the end part region in a case where a printing condition indicated by the information acquired by the first acquisition unit is a second printing condition different from the first printing condition and the density of the image indicated by the information acquired by the second acquisition unit is the first value is smaller than the number of the second dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value; and (iii) the number of the second dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the second value is smaller than the number of the second dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value, and the number of the first dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the second value is larger than the number of the first dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value.

In a third aspect of the present invention, there is provided an image processing apparatus that performs processing on multivalued image data corresponding to a unit region for printing an image in the unit region including a plurality of pixel regions on a printing medium by a plurality of scans of a an eject port column in which a plurality of eject ports for ejecting ink are arrayed in a predetermined direction with respect to the printing medium, wherein the plurality of eject ports ejects ink to each of the plurality of pixel regions on the printing medium in accordance with dot printing data corresponding to each of the plurality of scans, and by conveying the printing medium between the plurality of scans, the image processing apparatus comprising: a first acquisition unit configured to acquire information on printing conditions; a second acquisition unit configured to acquire information on a density of an image that is printed in the pixel region; a third acquisition unit configured to acquire N (≥3)-valued quantized data corresponding to the pixel region based on the image data; a fourth acquisition unit configured to acquire a plurality of dot arrangement pattern groups including at least a first dot arrangement pattern group including a plurality of first dot arrangement patterns in which an arrangement of dots is determined so that the number and position of dots that are printed within the pixel region are different in accordance with a value of the N-valued quantized data and a second dot arrangement pattern group including a plurality of second dot arrangement patterns in which an arrangement of dots is determined so that the number and position of dots that are printed within the pixel region are different in accordance with a value of the N-valued quantized data; a setting unit configured to set one dot arrangement pattern group from the plurality of dot arrangement pattern groups acquired by the fourth acquisition unit in accordance with the positions of the plurality of pixel regions within the unit region; and a generation unit configured to generate the dot printing data based on the N-valued quantized data acquired by the third acquisition unit and the dot arrangement pattern group set by the setting unit, wherein the number of dots that are printed within the pixel region determined by the second dot arrangement pattern corresponding to the N-valued quantized data having a predetermined value is larger than the number of dots that are printed within the pixel region determined by the first dot arrangement pattern corresponding to the N-valued quantized data having the predetermined value, and the setting unit sets the dot arrangement pattern group so that: (i) the number of the second dot arrangement pattern groups determined for the plurality of pixel regions located in an end part region corresponding to an end part of the eject port column in the predetermined direction within the unit region in a case where a printing condition indicated by the information acquired by the first acquisition unit is a first printing condition and the density of the image indicated by the information acquired by the second acquisition unit is a first value is smaller than the number of the second dot arrangement pattern groups determined for the plurality of pixel regions located in the end part region in a case where a printing condition indicated by the information acquired by the first acquisition unit is the first printing condition and the density of the image indicated by the information acquired by the second acquisition unit is a second value higher than the first value; (ii) the number of the second dot arrangement pattern groups determined for the plurality of pixel regions located in the end part region in a case where a printing condition indicated by the information acquired by the first acquisition unit is a second printing condition different from the first printing condition and the density of the image indicated by the information acquired by the second acquisition unit is the first value is smaller than the number of the second dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value; and (iii) the number of the second dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the second value is smaller than the number of the second dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value, and the number of the first dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the second value is larger than the number of the first dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value.

In a fourth aspect of the present invention, there is provided an image processing apparatus that performs processing on multivalued image data corresponding to a unit region for printing an image in the unit region including a plurality of pixel regions on a printing medium by a plurality of scans of a an eject port column in which a plurality of eject ports for ejecting ink are arrayed in a predetermined direction with respect to the printing medium, wherein the plurality of eject ports ejects ink to each of the plurality of pixel regions on the printing medium in accordance with dot printing data corresponding to each of the plurality of scans, and by conveying the printing medium between the plurality of scans, the image processing apparatus comprising: a first acquisition unit configured to acquire information on printing conditions; a second acquisition unit configured to acquire information on a density of an image that is printed in the pixel region; a third acquisition unit configured to acquire N (≥3)-valued quantized data corresponding to the pixel region based on the image data; a fourth acquisition unit configured to acquire a plurality of dot arrangement pattern groups including at least a first dot arrangement pattern group including a plurality of first dot arrangement patterns in which an arrangement of dots is determined so that the number and position of dots that are printed within the pixel region are different in accordance with a value of the N-valued quantized data and a second dot arrangement pattern group including a plurality of second dot arrangement patterns in which an arrangement of dots is determined so that the number and position of dots that are printed within the pixel region are different in accordance with a value of the N-valued quantized data; a setting unit configured to set one dot arrangement pattern group from the plurality of dot arrangement pattern groups acquired by the fourth acquisition unit in accordance with the positions of the plurality of pixel regions within the unit region; and a generation unit configured to generate the dot printing data based on the N-valued quantized data acquired by the third acquisition unit and the dot arrangement pattern group set by the setting unit, wherein the number of dots that are printed within the pixel region determined by the second dot arrangement pattern corresponding to the N-valued quantized data having a predetermined value of the first and second dot arrangement pattern groups is smaller than the number of dots that are printed within the pixel region determined by the first dot arrangement pattern corresponding to the N-valued quantized data having the predetermined value, and the setting unit sets the dot arrangement pattern group so that the number of the second dot arrangement pattern groups determined for the plurality of pixel regions located in the end part region in a case where a printing condition indicated by the information acquired by the first acquisition unit is a first printing condition and the density of the image indicated by the information acquired by the second acquisition unit is a predetermined value is smaller than the number of the second dot arrangement pattern groups determined for the plurality of pixel regions located in the end part region in a case where a printing condition indicated by the information acquired by the first acquisition unit is a second printing condition different from the first printing condition and the density of the image indicated by the information acquired by the second acquisition unit is the predetermined value, and the number of the first dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the predetermined value is larger than the number of the first dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the predetermined value.

Further features of the present invention will become apparent from the following description of exemplary embodiments (with reference to the attached drawings).

BRIEF DESCRIPTION OF THE DRAWINGS

FIG. 8 is a diagram showing a table setting matrix α;

FIG. 9 is a diagram showing a table for setting density increase/decrease parameters P from evaluation values;

FIGS. 11A to 11C are diagrams showing a table setting matrix and pattern selection tables in the case where a correction width is set to three pixels;

FIGS. 14A to 14C are diagrams showing a table setting matrix and pattern selection tables in the case where a correction width is set to two pixels;

FIGS. 16A and 16B are diagrams showing pattern selection tables used in the sixth embodiment;

FIGS. 20A to 20F are diagrams showing pattern selection tables and table setting matrixes used in an eighth embodiment;

FIGS. 21A to 21F are diagrams showing pattern selection tables and table setting matrixes in the case where a correction width is provided at an upper end;

FIG. 22 is a diagram showing another example of the table setting matrix; and FIGS. 23A to 23C are diagrams each showing a method for obtaining a pattern table at the time of printing.

DESCRIPTION OF THE EMBODIMENTS

Hereinafter, embodiments of the present invention are explained in detail with reference to the drawings.

<Explanation of Printing Apparatus>

Figure 1:
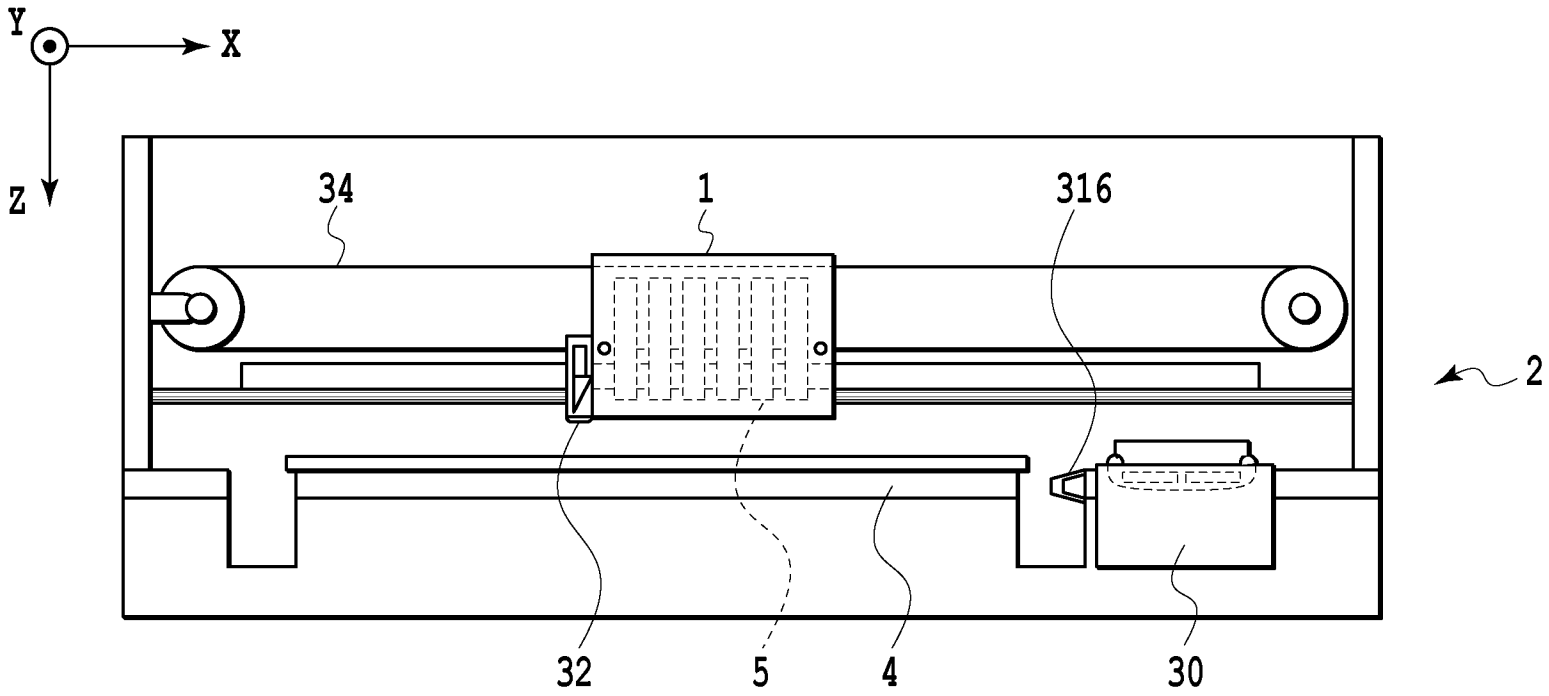
FIG. 1 is a sectional side elevation explaining a configuration of an ink jet printing apparatus that can be used in the present invention.

FIG. 1 is a sectional side elevation for explaining a configuration of a printing unit of an ink jet printing apparatus 2 (hereinafter, also referred to simply as a printing apparatus) that can be used in the present invention. A carriage 1 mounting six printing heads 5 and an optical sensor 32 is enabled to reciprocate in an X direction in FIG. 1 by a drive force of a carriage motor transmitted via a belt 34. While the carriage 1 is moving relatively in the X direction with respect to a printing medium, the printing head 5 ejects ink in a Z direction in accordance with printing data, and thereby, an image corresponding to one scan is printed on a printing medium arranged on a platen 4. After the one printing scan is completed, the printing medium is conveyed in a Y direction (conveyance direction) intersecting the X direction in FIG. 1 by a distance corresponding to a printing width of one scan. By alternately repeating the printing scan and the conveyance operation such as these a plurality of times, an image is formed gradually on the printing medium.

The optical sensor 32 determines whether or not there exists a printing medium on the platen 4 by performing the detection operation while moving together with the carriage 1. At a position in the scan region of the carriage 1 and apart from the platen 4, a recovery unit 30 configured to perform maintenance processing of the printing head 5 is arranged.

<Explanation of Printing Head>

Figure 2:
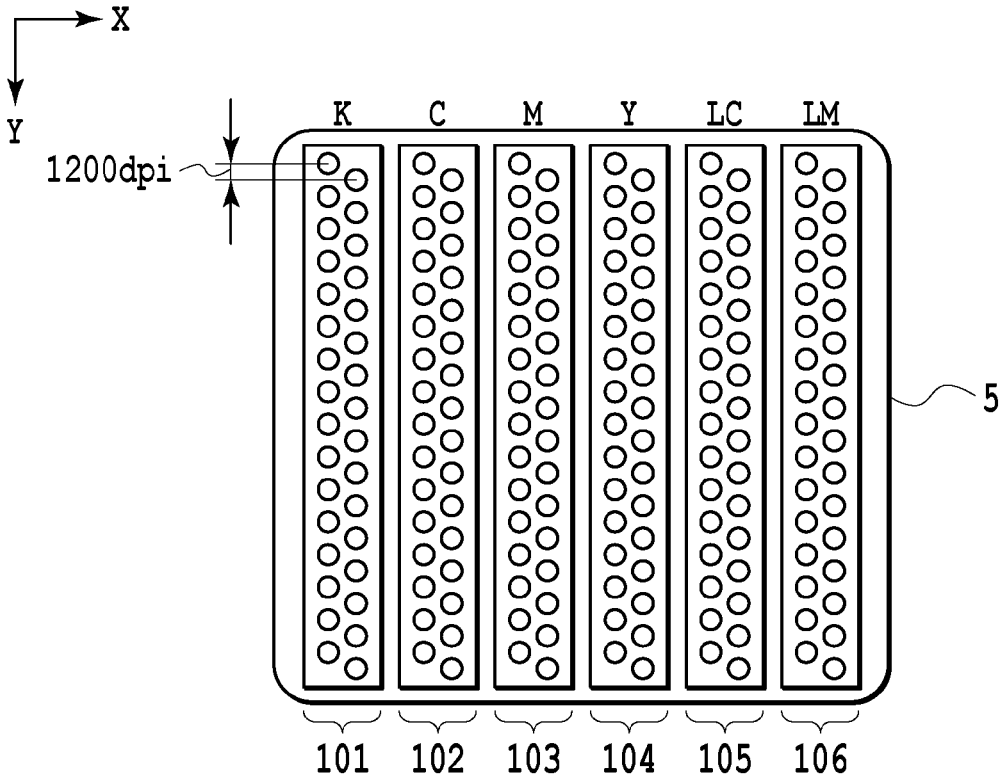
FIG. 2 is a diagram in the case where a printing head is viewed from an eject port surface side.

FIG. 2 is a diagram in the case where the printing head 5 is viewed from the eject port surface side. In the printing head 5, six eject port columns 101 to 106 are arranged in parallel in the X direction. In each of the eject port columns 101 to 106, a plurality of eject ports (here, 32 eject ports) for ejecting ink as a droplet is arrayed at a pitch of 1,200 dpi in the Y direction (array direction). The eject port columns 101 to 106 eject black (K), cyan (C), magenta (M), yellow (Y), light cyan (Lc), and light magenta (Lm) inks, respectively.

<Explanation of Control Unit>

Figure 3:
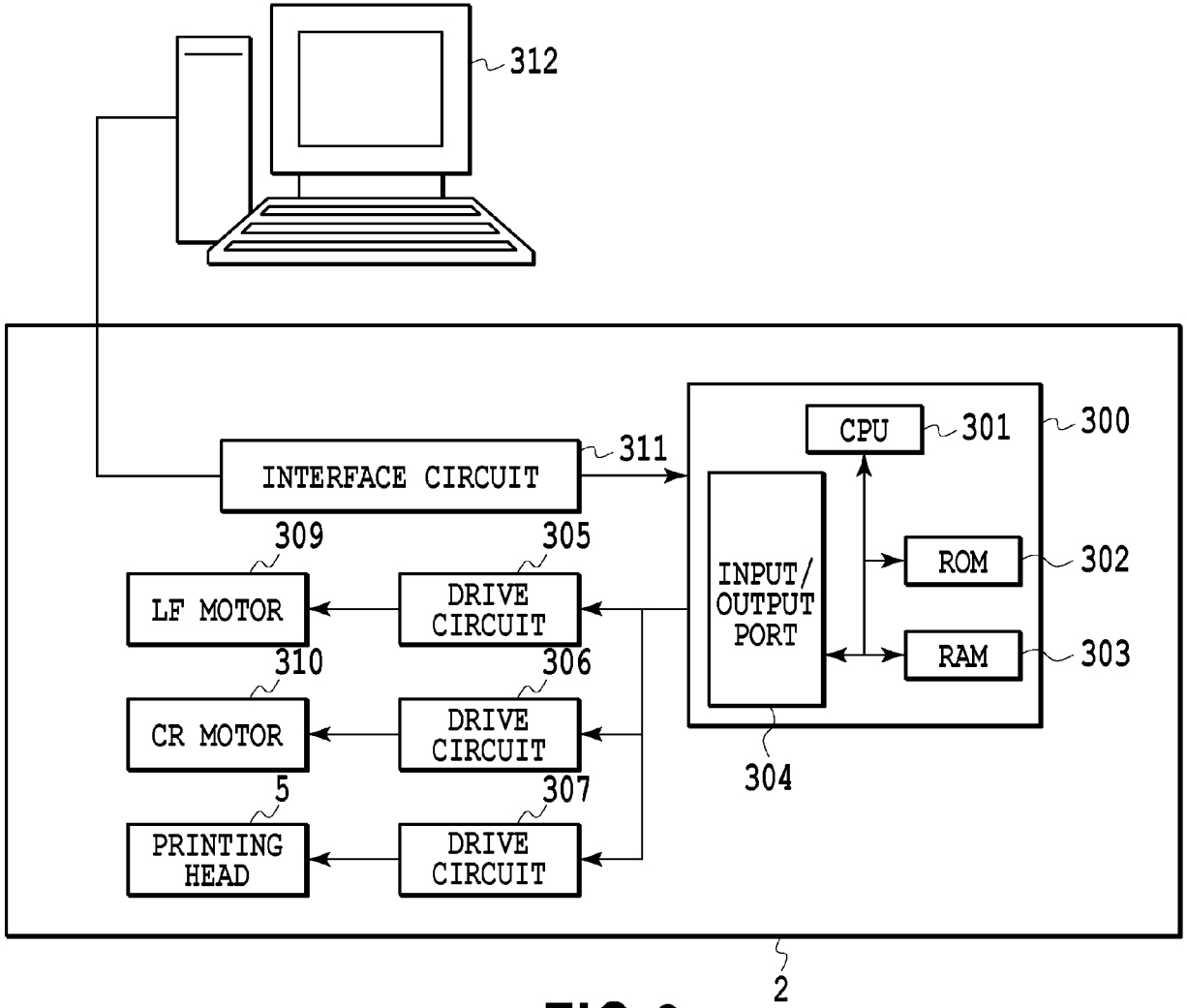
FIG. 3 is a block diagram showing an outline configuration of a control system in an ink jet printing apparatus 2.

FIG. 3 is a block diagram showing an outline configuration (printing control apparatus) of a control system in the ink jet printing apparatus 2. A main control unit 300 includes a CPU 301 that performs processing operations, such as arithmetic operation, selection, determination, and control, a ROM 302 storing programs etc. to be executed by the CPU 301, a RAM 303 used as a buffer etc. of printing data, an input/output port 304, etc. To the input/output port 304, drive circuits 305, 306, and 307 for driving an LF motor 309 for controlling the conveyance of the printing medium, a CR motor 310 for controlling the printing scan by causing the carriage 1 to reciprocate, and each of the printing heads 5 respectively are connected. Further, these components are also connected to a host computer 312 via an interface circuit 311. The characteristic control of the present invention that will be explained below is performed by a printer driver installed in the host computer 312 or performed by the CPU 301 of the printing apparatus 2 in accordance with the programs and various kinds of parameters stored in the ROM 302.

<Explanation of Printing Data Generation Processing>

Figure 4:
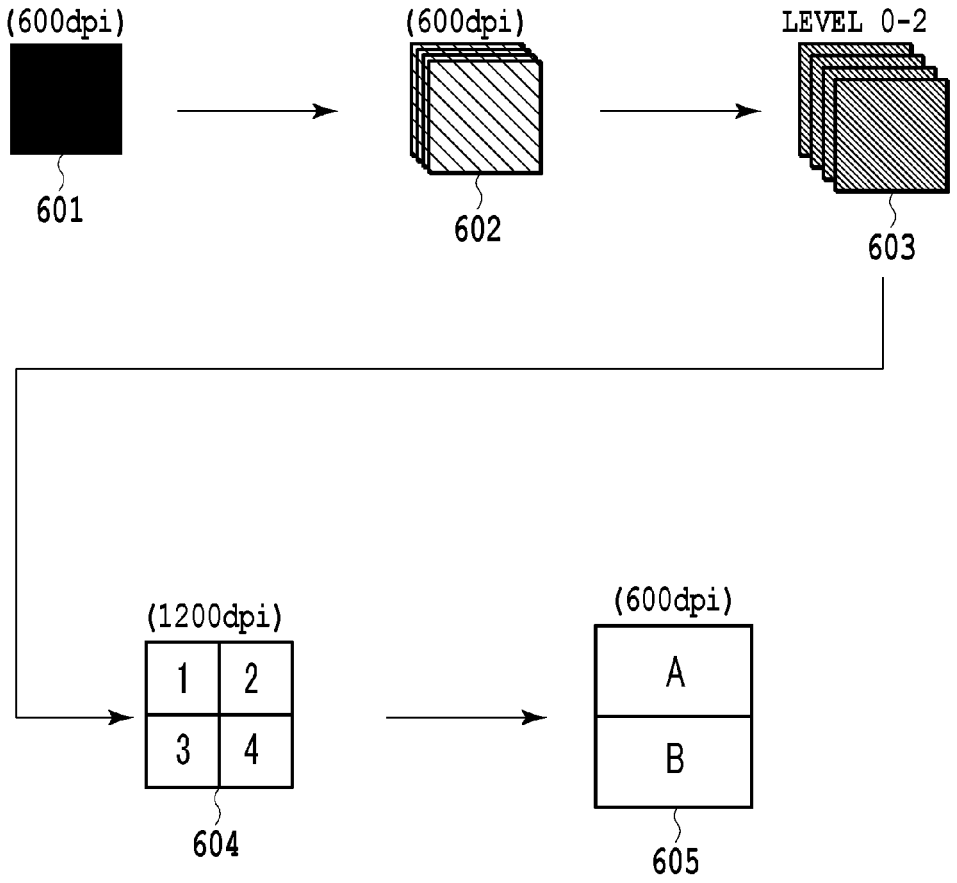
FIG. 4 is a diagram explaining image processing of the present invention.

FIG. 4 is a diagram explaining conversion processing of image data performed by the host computer 312 and the printing apparatus 2. Original image data 601 is 600 dpi RGB data and the printer driver first converts the image data 601 into 600 dpi density data 602 corresponding to the ink colors CMYKLcLm used by the printing apparatus 2. After that, by using the multivalued error diffusion method or the dither method, the density data 602 of each of CMYKLcLm is converted into quantized data 603 having three levels (number of gradations) of 0 to 2. Here, quantization into three-valued data is shown as an example, but a number N of values for quantization is not limited to three. The host computer 312 transfers the quantized data of each color in this state to the printing apparatus 2.

The CPU 301 having received the three-valued image data converts the 600 dpi quantized data 603 into 1,200 dpi binary printing data 604 by referring to a dot arrangement pattern stored in the ROM 302 in advance. Further, after performing processing characteristic to the present invention, as will be described later, the printing data is accumulated in a print buffer prepared within the RAM 303. The printing data is binary data that determines printing (1) or non-printing (0) for each of 2×2 pixels arrayed in 1,200 dpi.

After the printing data corresponding to one or more scans is accumulated in the RAM 303, the CPU 301 performs a printing operation based on the printing data 604 in accordance with the program stored in the ROM 302. Specifically, the CPU 301 causes the printing head 5 to perform the eject operation while reading the binary printing data 604 by an amount corresponding to one scan each time. At this time, the printing resolution in the main scan direction may be set to 1,200 dpi, but it may also be set to 600 dpi. In the case of 600 dpi, the dots corresponding to printing data 1 and 2 put side by side in the main scan direction are printed repeatedly at a pixel position A as is known by referring to printing results 605. Dots corresponding to printing data 3 and 4 are printed repeatedly at a pixel position B. The CPU 301 prints an image corresponding to one page on a printing medium by causing the printing head 5 to perform the eject operation in accordance with the printing data 604 while controlling the drive of the various kinds of motors as required via the input/output port 304.

Figure 5:
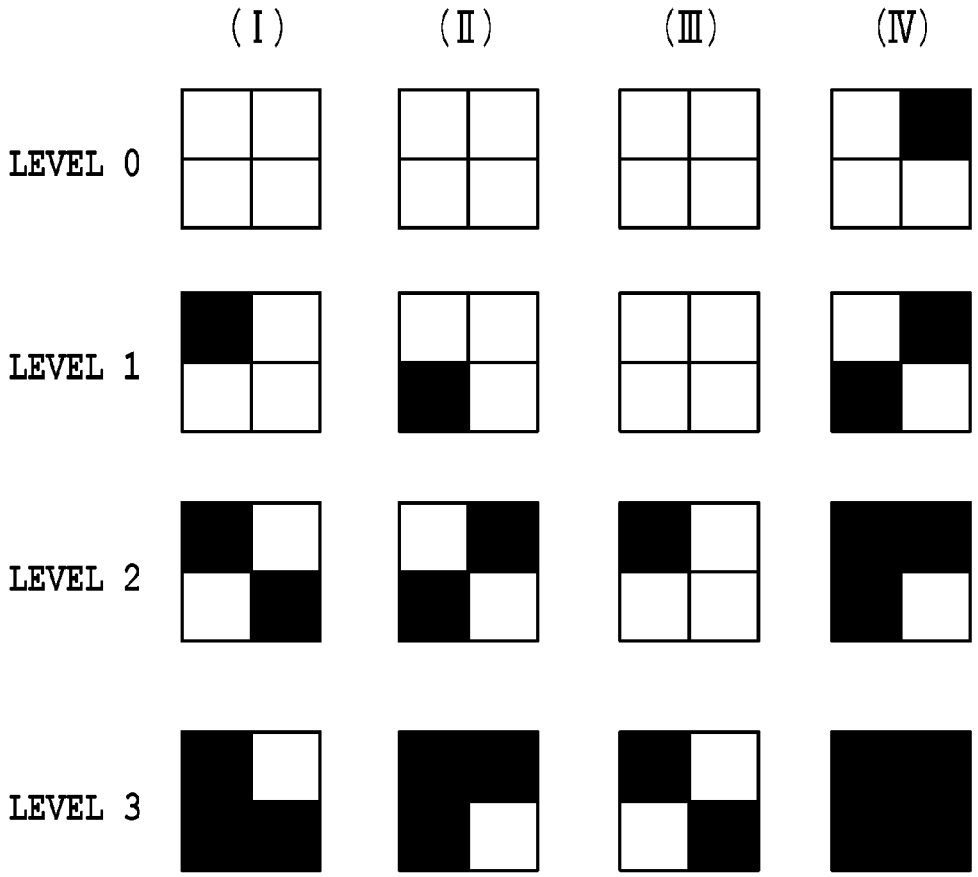
FIG. 5 is a diagram showing an example of a dot arrangement pattern stored in a ROM.

FIG. 5 is a diagram showing an example of a dot arrangement pattern stored in the ROM 302. The CPU 301 selects a dot arrangement pattern in which printing of dots (black) or non-printing of dots (white) is determined for each of 2×2 areas in accordance with 600 dpi quantized data indicating any of levels 0 to 3. Usually, the number of dots that are printed in the 2×2 areas corresponding to the pixel regions increases as the level number increases, and here, four kinds of dot arrangement patterns I to IV in which the way the number of dots increases is different from one another are prepared. Hereinafter, the contents of the dot arrangement patterns I to IV are explained specifically.

As to level 0, the number of printing pixels (area represented in black) is zero in the patterns I to III and that is one in the pattern IV. As to level 1, the number of printing pixels is one in the patterns I and II, that is zero in the pattern III, and that is two in the pattern IV. As to level 2, the number of printing pixels is two in the patterns I and II, that is one in the pattern III, and that is three in the pattern IV. Further, as to level 3, the number of printing pixels is three in the patterns I and II, that is two in the pattern III, and that is four in the pattern IV. By comparing the four kinds of patterns, it is known that in the patterns I and II, the number of printing pixels increases in regular order as the level number increases, but in the pattern III, the number of printing pixels is made equal to or less than that in the patterns I and II and in the pattern IV, the number of printing pixels is increased compared to that in the patterns I and II. It is known that the number of low frequency components in the frequency region included in the binary data generated by using the pattern III is larger than the number of low frequency components in the frequency region included in the binary data generated by using the patterns I and II. Further, it is also known that the number of high frequency components in the frequency region included in the binary data generated by using the pattern IV is larger than the number of high frequency components in the frequency region included in the binary data generated by using the patterns I and II. In the present specification, the pattern in which the number of printing pixels increases in regular order as the level number increases, as the patterns I and II, is referred to as a first dot arrangement pattern group. The pattern in which the number of printing pixels is larger or smaller than that of the first dot arrangement pattern, such as the pattern III and the pattern IV, is referred to as a second dot arrangement pattern group. In the present embodiment, these four kinds of dot arrangement patterns are prepared and at the boundary part where the black streak is comparatively apt to be conspicuous, the binarization processing is performed by referring to the pattern III in order to make the black streak no longer conspicuous by suppressing the number of dots. At the boundary part where the white streak is comparatively apt to be conspicuous, the binarization processing is performed by referring to the pattern IV in order to make the white streak no longer conspicuous by increasing the number of dots. In FIG. 5, the four kinds of dot arrangement patterns are explained, but it is also possible to prepare more dot arrangement patterns in which the position of the printing pixel is made different from one another.

Figure 6:
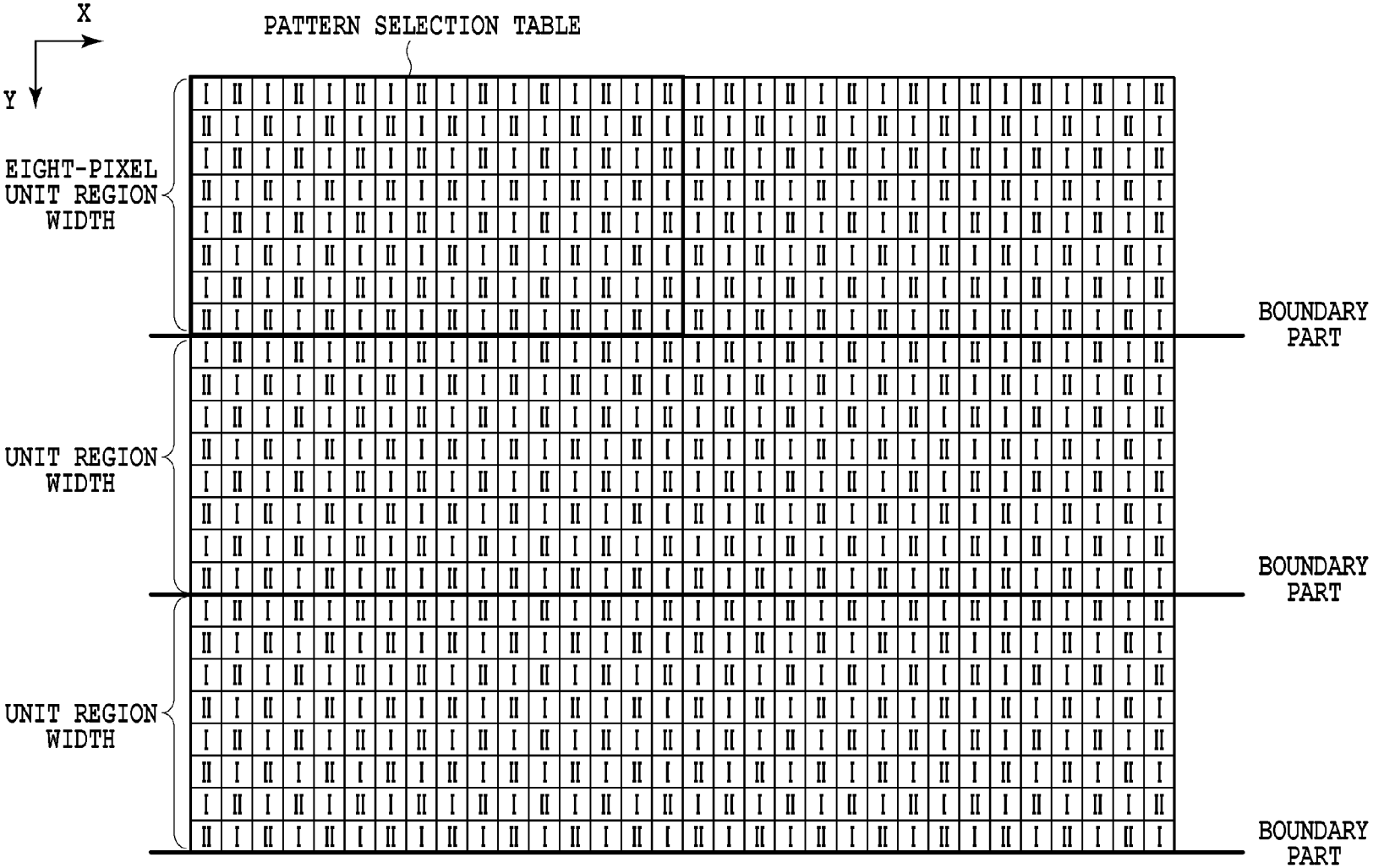
FIG. 6 is a diagram showing a pattern selection table for setting a dot arrangement pattern.

FIG. 6 is a diagram showing a pattern selection table for setting a dot arrangement pattern that is used in each of the pixels arrayed in 600 dpi. Here, in order to make explanation simple, the case is shown where one-pass printing is performed for a unit region on a printing medium by using each 16 eject ports of each eject port column. In this case, in the printing scan performed once, the 600 dpi unit region having a width of eight pixels is printed and in FIG. 6, the width in the Y direction of the unit region that is printed by the printing scan performed once is shown as a unit region width and the boundary part between each printing scan is shown as a boundary part between the unit regions. In FIG. 6, the pattern selection table has the region including eight pixels that agrees with the unit region width in the Y direction and 16 pixels in the X direction, and the pattern I or II is set in all the pixels within the pattern selection table. The pattern selection table such as this is used repeatedly in the X direction (main scan direction) and in the Y direction (sub scan direction).

Figure 7A:
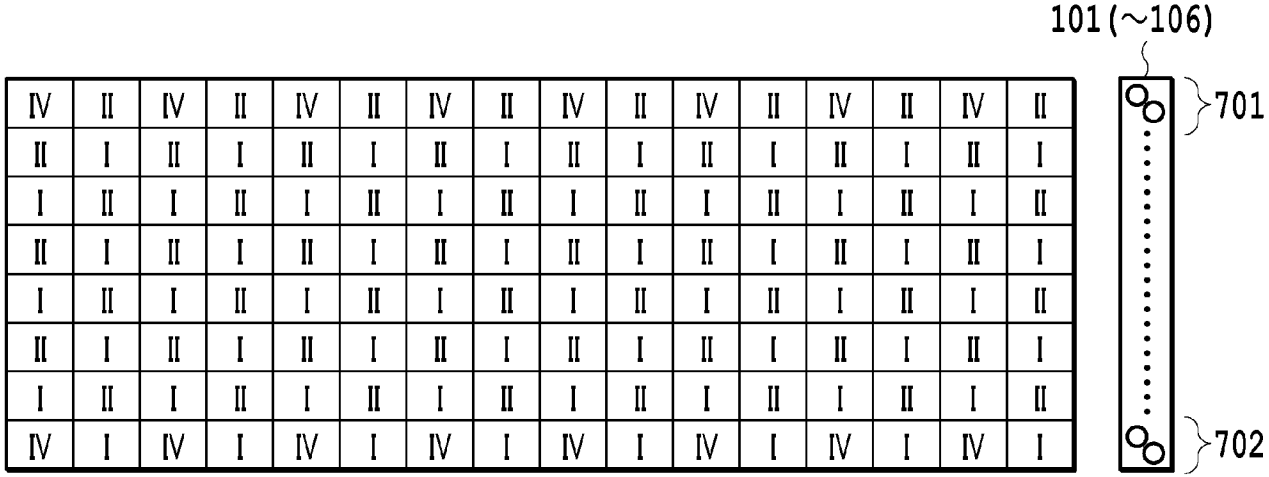
FIGS. 7A and 7B are diagrams showing pattern selection tables for dealing with a joint streak.
Figure 7B:
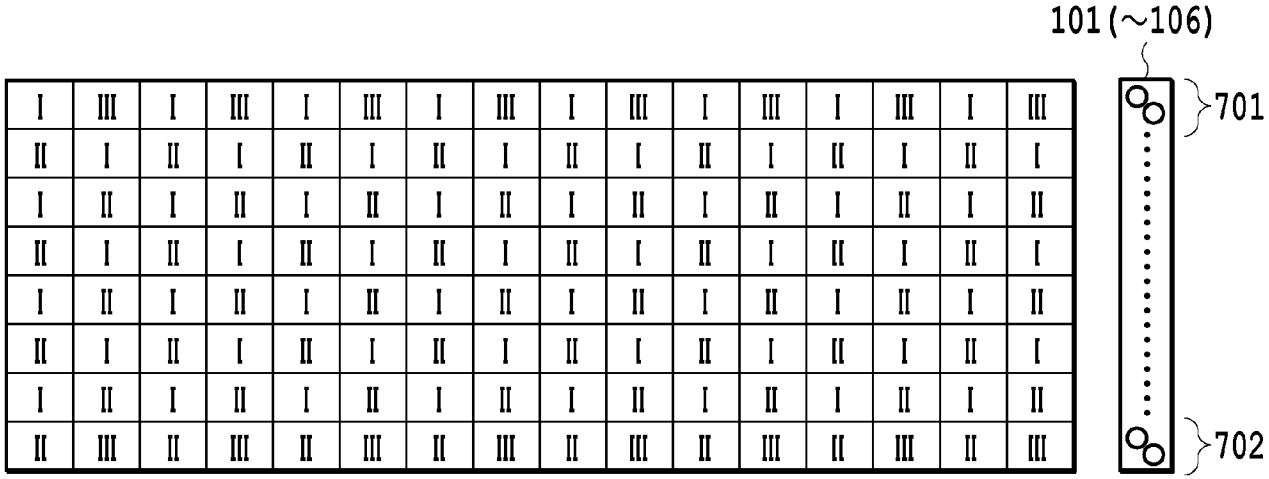

FIGS. 7A and 7B are diagrams showing pattern selection tables A and B for dealing with the joint streak that are used in the present embodiment. In the pattern selection table A shown in FIG. 7A, in the one-pixel width at the upper end, the patterns II and IV are set alternately and in the one-pixel width at the lower end, the patterns I and IV are set alternately. In the six-pixel width at the center except for the upper end and the lower end, the patterns I and II are set alternately. The one-pixel width at the upper end corresponds to two eject ports (first eject port group) 701 arranged at one end part of the eject port column and the one-pixel width at the lower end corresponds to two eject ports (second eject port group) 702 arranged at the other end part of the eject port column. Then, the region that is printed by the first eject port group 701 in the first printing scan performed earlier, and the region that is printed by the second eject port group 702 in the second printing scan performed following the first printing scan are arranged adjacent to each other and the boundary therebetween forms the joint part.

In the case where the pattern selection table A such as this is used, in the one-pixel widths at the upper end and at the lower end, printing is performed with more dots increased by addition than those at the center as a result. In other words, the number of times of eject of the first eject port group 701 and the second eject port group 702 is increased compared to that of the eject ports other than these eject port groups. Because of this, the pattern selection table A will be a table effective in the case where the white streak is conspicuous at the boundary between the region that is printed by the first eject port group in the first printing scan and the region that is printed by the second eject port group in the second printing scan.

On the other hand, in the pattern selection table B shown in FIG. 7B, in the one-pixel width at the upper end, the patterns I and III are set alternately and in the one-pixel width at the lower end, the patterns II and III are set alternately. Then, in the six-pixel width at the center except for the upper end and the lower end, the patterns I and II are set alternately. In the case where the pattern selection table B is used, in the one-pixel widths at the upper end and at the lower end, printing is performed with less dots decreased by reduction than those at the center as a result. In other words, the number of times of eject of the first eject port group 701 and the second eject port group 702 is reduced. The pattern selection table B will be a table effective in the case where the black streak is conspicuous at the boundary between the region that is printed by the first eject port group in the first printing scan and the region that is printed by the second eject port group in the second printing scan.

Conspicuity of the black streak or the white streak varies in accordance with the image density. For example, even in the case where printing is performed on the same printing medium by using the same ink, the black streak that is conspicuous in the low density may be less conspicuous in the high density. In such circumstances, in the case where the pattern selection table B shown in FIG. 7B is used at all times in order to reduce the black streak, dots are thinned uniformly by the dot arrangement pattern III for both level 1 and level 2. As a result of that, in the region configured mainly by level 2 where the density is high, there is a possibility that the white streak will occur due to excessive correction. In other words, it can be said that preferably, whether to use the pattern selection table A or the pattern selection table B is adjusted in accordance with the gradation value of each pixel. Because of this, a table setting matrix and a density increase/decrease parameter P for selecting an appropriate dot arrangement pattern in accordance with the gradation value are prepared.

FIG. 8 is a diagram showing a table setting matrix α. The table setting matrix α has the same region as that of the pattern selection tables A and B, i.e., the region of 16 pixels in the main scan direction×eight pixels in the sub scan direction and in individual pixels, parameters 1 to 16 are allocated as in FIG. 8. In each pixel in the one-pixel width at the upper end and in the one-pixel width at the lower end, one and the different one of parameters 1 to 16 is allocated in random order and in the six-pixel width region at the center, 16 is allocated uniformly. In the present embodiment, each parameter in the table setting matrix α is compared with the density increase/decrease parameter P. Then, based on the relationship in magnitude between both, whether the dot arrangement pattern is set in accordance with the pattern selection table A or the dot arrangement pattern is set in accordance with the pattern selection table B is determined. By doing so, it is possible to adjust the ratio in which the pattern selection table A and the pattern selection table B are set in the 16 pixels arranged at the upper and lower ends by setting the density increase/decrease parameter P large or small.

Here, a method for setting the density increase/decrease parameter P is explained. The density increase/decrease parameter P is adjusted so that the more conspicuous the white streak, the more the pattern selection tables A are set and the more conspicuous the black streak, the more the pattern selection tables B are set in an image that is printed. At this time, conspicuity of the white streak or the black streak can be determined by, for example, the L*a*b* value of the original image data, but here, an example is explained in which the density data 602 of black K is used as an evaluation value. In this case, the evaluation value may take a value between 0 and 255.

FIG. 9 is a diagram showing a table for setting the density increase/decrease parameter P of 0 to 16 from the evaluation value (black density data) between 0 and 255. In this example, both are associated with each other so that the higher the black density value, the lower the density increase/decrease parameter P is.

Figure 10A:
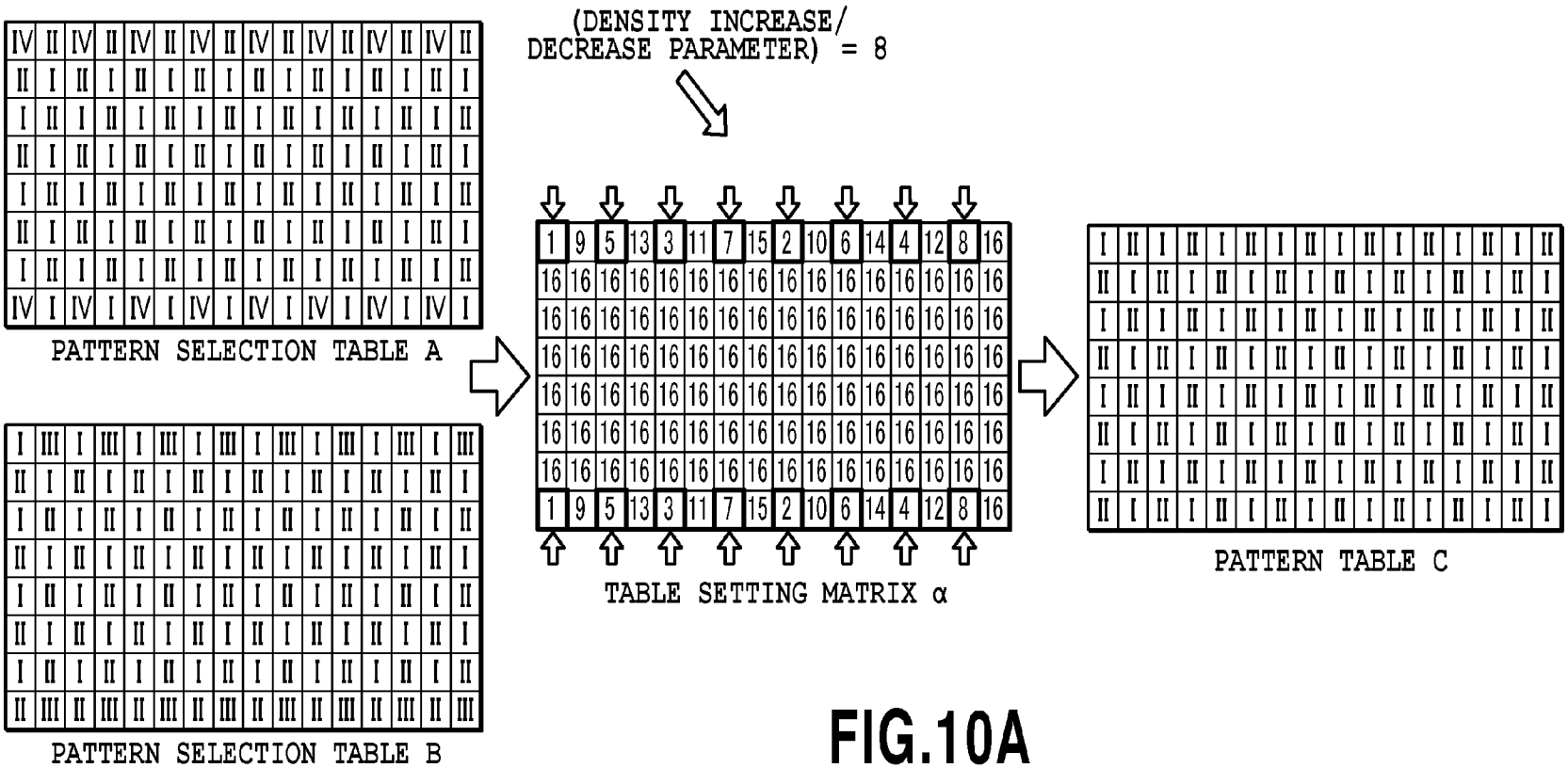
FIGS. 10A to 10C are diagrams each showing a method for obtaining a pattern table at the time of printing.
Figure 10B:
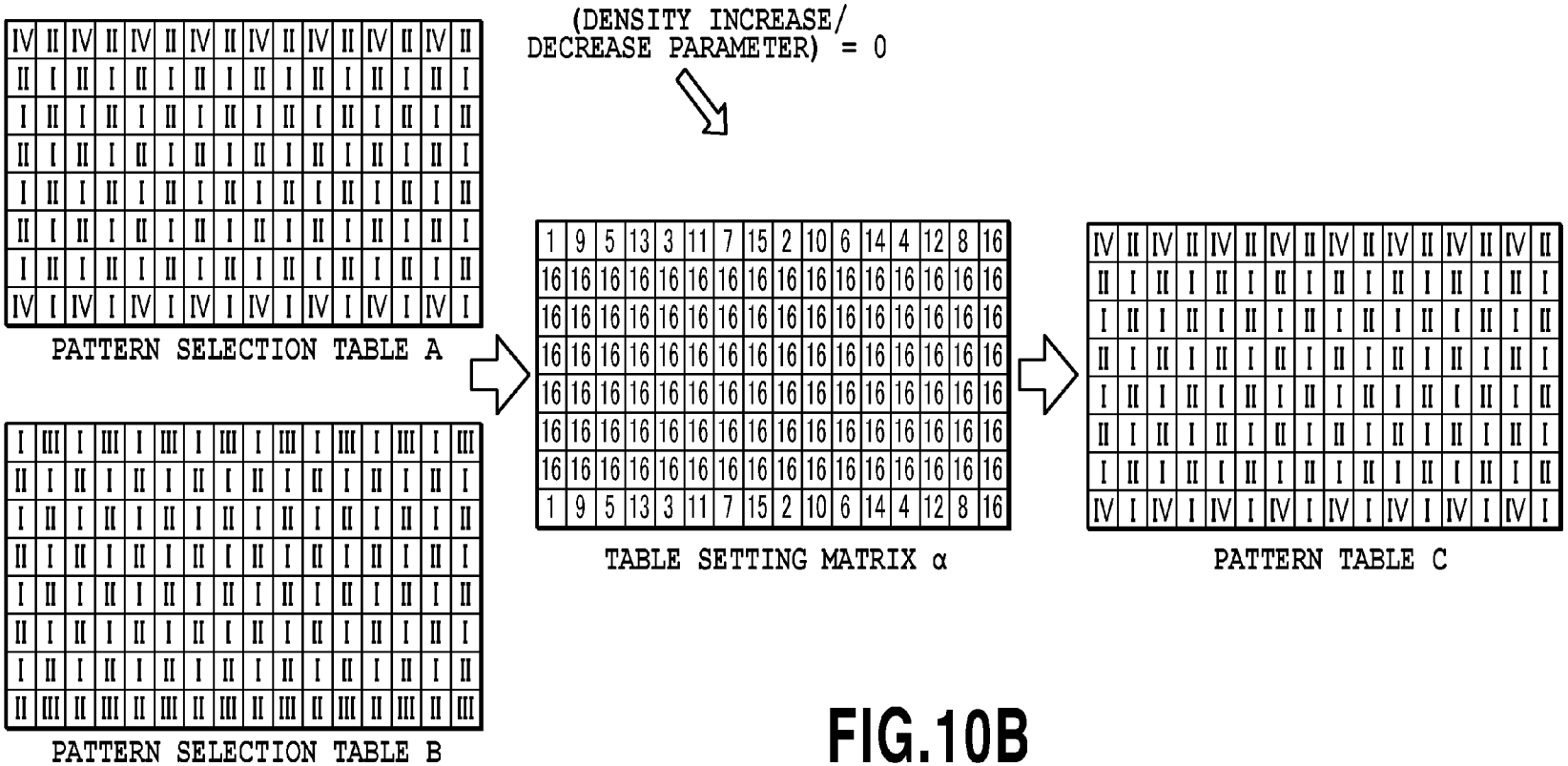
Figure 10C:
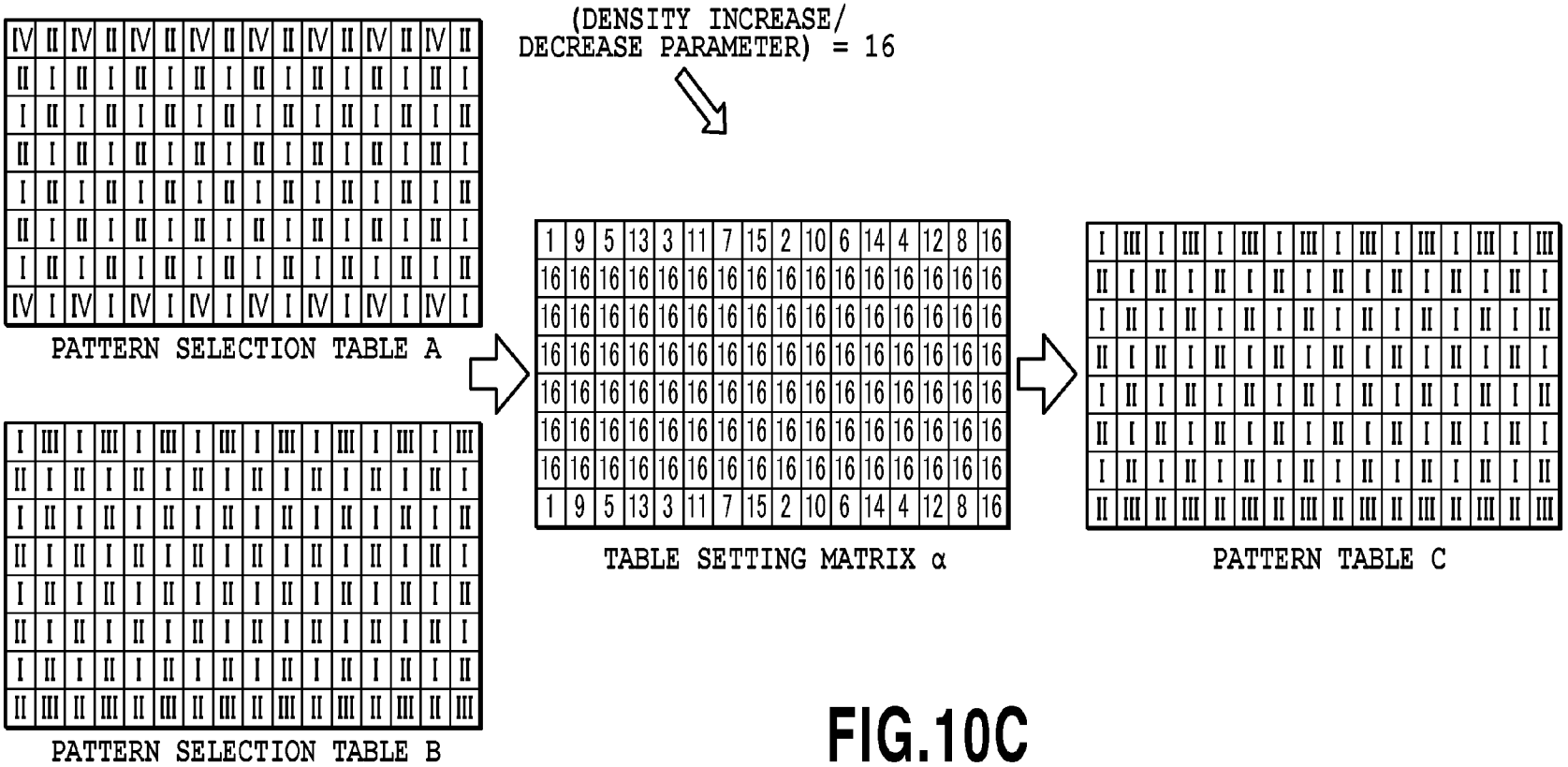

FIGS. 10A to 10C are diagrams each explaining a method for obtaining a pattern table C that is used for actual printing from the table setting matrix α shown in FIG. 8 and the density increase/decrease parameter P selected by using the table in FIG. 9. FIG. 10A is a diagram showing the case where the density increase/decrease parameter P is set to "8".

In the present embodiment, the dot arrangement pattern that is used in each pixel is determined by comparing the parameter set for each pixel by the table setting matrix α with the density increase/decrease parameter P. Specifically, in the case where the parameter of the table setting matrix α is larger than the density increase/decrease parameter P, to the pixel, the dot arrangement pattern set to the corresponding pixel of the pattern selection table A is allocated. On the other hand, in the case where the parameter of the table setting matrix α is equal to or smaller than the density increase/decrease parameter P, to the pixel, the dot arrangement pattern set to the corresponding pixel of the pattern selection table B is allocated.

For example, in the region except for the pixel rows at the upper and lower ends of the table setting matrix α, the parameter data is uniformly "16" and this is larger than the density increase/decrease parameter P="8". Consequently, in this region, the dot arrangement patterns I and II set in the corresponding region of the pattern selection table A are set exactly in accordance with the array. On the other hand, the parameters in the pixel row regions at the upper and lower ends of the table setting matrix α are "1" to "16" and half the parameters are larger than the density increase/decrease parameter P="8" but the remaining half are equal to or less than the density increase/decrease parameter P="8". Because of this, in these regions, the dot arrangement pattern II set in the pattern selection table A and the dot arrangement pattern I set in the pattern selection table B are allocated alternately in accordance with the pixel position. As a result of that, in the pattern table C that is used for actual printing, the dot arrangement patterns I and II are alternately arranged uniformly both in the pixel row regions at the upper and lower ends and in the other region.

Here, referring to FIG. 5 again, the dot arrangement patterns I and II of the present embodiment are patterns that do not cause the addition or reduction of dots. In other words, in the case where the density increase/decrease parameter P="8", the dot arrangement pattern I or II is used uniformly both in the boundary region and in the non-boundary region and no dots are added to or reduced from the boundary region as a result. In other words, in the case of the condition under which the white streak or the black streak is not conspicuous in particular, it is designed so that the density increase/decrease parameter P is set to "8". Then, in the table setting matrix α and in the pattern selection tables A and B, the parameters of the individual pixels are set so that the dot arrangement patterns I and II are arranged alternately in all the pixel regions in the case where the density increase/decrease parameter P="8".

On the other hand, FIG. 10B is a diagram showing the case where the density increase/decrease parameter P is set to "0" in all the pixels. The table setting matrix α and the pattern selection tables are the same as those in FIG. 10A. In the region except for the pixel rows at the upper and lower ends of the table setting matrix α, the parameters are uniformly "16" and are larger than the density increase/decrease parameter "0". Because of this, in this region, as in FIG. 10A, the dot arrangement patterns I and II set in the corresponding region of the pattern selection table A are set exactly in accordance with the array. On the other hand, the parameters in the pixel row regions at the upper and lower ends of the table setting matrix α are any of "1" to "16" and in all the pixels, parameters are larger than the density increase/decrease parameter P="0". Because of this, in these regions, the dot arrangement patterns II and IV are allocated alternately in accordance with the pattern selection table A in all the pixels. In other words, the pattern table C that is used for actual printing will be the same as the pattern selection table A. In the pattern table C, the 16, in total, dot arrangement patterns IV are allocated as a result.

Here, referring to FIG. 5 again, the dot arrangement pattern IV that is arranged only in the one pixel row at the upper and lower ends is a pattern that causes the addition of dots. In other words, in the case where the density increase/decrease parameter P="0", correction is performed so as to add dots to the end part regions (two pixel rows at the upper and lower ends). Further, the table setting matrix α in the present embodiment is set so that the number of dot arrangement patterns IV that are arranged increases as the density increase/decrease parameter decreases in the range in which the density increase/decrease parameter is 0 to 8. Consequently, it is designed so that as the density increase/decrease parameter approaches 0 (i.e., the density of an image is high and the white streak becomes more apt to be conspicuous), the number of dots that are added to the end part regions increases.

Further, FIG. 10C is a diagram showing the case where the density increase/decrease parameter P is set to "16" in all the pixels. The table setting matrix α and the pattern selection tables are the same as those in FIG. 10A. In the region except for the pixel rows at the upper and lower ends of the table setting matrix α, the parameters are uniformly "16" and are equal to the density increase/decrease parameter "16". Because of this, in this region, the dot arrangement patterns I and II set in the corresponding region of the pattern selection table B are set exactly in accordance with the array. On the other hand, the parameters in the pixel row regions at the upper and lower ends of the table setting matrix α are any of "1" to "16" and in all the pixels, the parameters are equal to or less than the density increase/decrease parameter "16". Because of this, in these regions, the dot arrangement patterns I and III are allocated alternately in accordance with the pattern selection table B in all the pixels. In the pattern table C, the 16, in total, dot arrangement patterns III are allocated as a result.

Here, referring to FIG. 5 again, the dot arrangement pattern III that is arranged only in the pixel rows at the upper and lower ends is a pattern that causes the reduction of dots. In other words, in the case where the density increase/decrease parameter is "16", correction is performed so as to reduce dots in the end part regions. Further, the table setting matrix α in the present embodiment is set so that the number of dot arrangement patterns III that are arranged increases as the density increase/decrease parameter increases in the range in which the density increase/decrease parameter is 9 to 16. Consequently, it is designed so that as the density increase/decrease parameter approaches 16 (i.e., the density of an image is low and the black streak becomes more apt to be conspicuous), the number of dots that are reduced from the end part regions increases.

As above, as explained by using FIGS. 10A to 10C, according to the present embodiment, although one set of the table setting matrix α and the pattern selection tables A and B is used, the density increase/decrease parameter is changed in accordance with the conspicuity of the black streak or the white streak. Due to this, it is made possible to adjust the addition or reduction of dots so that the black streak and the white streak are no longer conspicuous.

In the examples in FIGS. 10A to 10C, the width in the Y direction of the predetermined region in which the number of dots can be adjusted is only the one-pixel widths at the upper and lower ends (four-pixel width in 1,200 dpi), which sandwich the boundary part. However, the way dots spread on a printing medium varies in accordance with a variety of printing conditions, such as the combination of the printing medium and ink. Then, for example, in the case where dots spread widely across several pixels on a printing medium, there is a possibility that the joint streak is not eliminated sufficiently even by adjusting the number of dots only in the one-pixel widths at the upper and lower ends, which sandwich the boundary part. The inventors of the present invention have found out that, in order to effectively reduce the joint streak, it is effective not only to adjust the number of dots but also to adjust the correction width in which the number of dots can be increased or decreased in accordance with printing conditions.

FIGS. 11A to 11C are diagrams showing a table setting matrix and pattern selection tables whose correction width is enlarged by a factor of 3 compared to those in FIG. 7 and FIG. 8. In the present embodiment, a plurality of combinations of a table matrix and pattern setting tables whose correction width is made different from each other in accordance with printing conditions, such as the kind of ink are prepared in advance.

In a pattern selection table D shown in FIG. 11A, in the three-pixel width at the upper end, the patterns II and IV are set alternately and in the three-pixel width at the lower end, the patterns I and IV are set alternately. Then in the two-pixel width at the center except for the three-pixel width at the upper end and the three-pixel width at the lower end, the patterns I and II are set alternately. In the case where the pattern selection table D is used, in the respective three-pixel widths at the upper end and the lower end, printing is performed with more dots increased by addition than those at the center as a result. In other words, the pattern selection table D will be a table effective in the case where the white streak is conspicuous within the three-pixel width.

On the other hand, in a pattern selection table E shown in FIG. 11B, in the three-pixel width at the upper end, the patterns I and III are set alternately and in the three-pixel width at the lower end, the patterns II and III are set alternately. Then, in the two-pixel width at the center except for the three-pixel width at the upper end and the three-pixel width at the lower end, the patterns I and II are set alternately. In the case where the pattern selection table E such as this is used, in the respective three-pixel widths at the upper end and the lower end, printing is performed with less dots decreased by reduction than those at the center as a result. In other words, the pattern selection table E will be a table effective in the case where the black streak is conspicuous within the three-pixel width.

FIG. 11C is a diagram showing a table setting matrix β corresponding to the pattern selection tables D and E. To each pixel in each one-pixel width of the three-pixel widths at the upper and lower ends, one and the different one of parameters 1 to 16 is allocated and to the two-pixel width region at the center, 16 is allocated uniformly. By setting the dot arrangement pattern of each pixel in accordance with the method explained in FIGS. 10A to 10C while using the combination of the table setting matrix β and the pattern selection tables D and E, it is made possible to adjust the addition or reduction of dots within the three-pixel width.

Figure 23B:
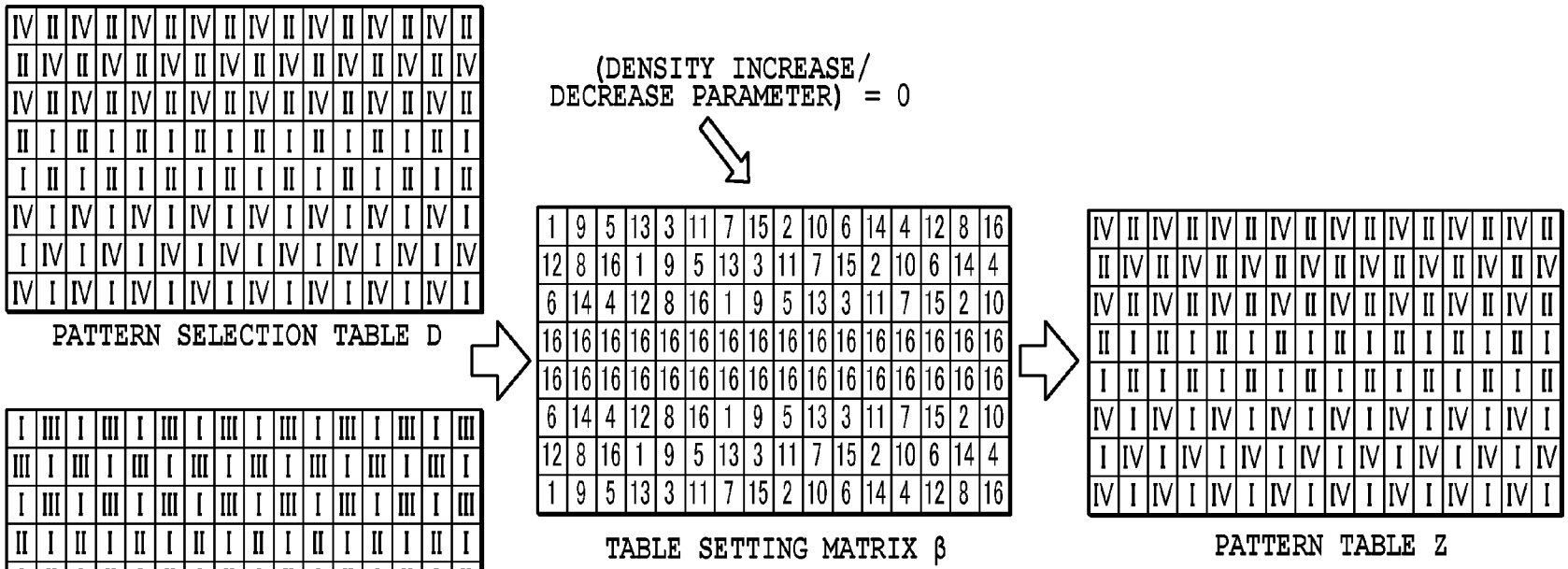
Figure 23C:
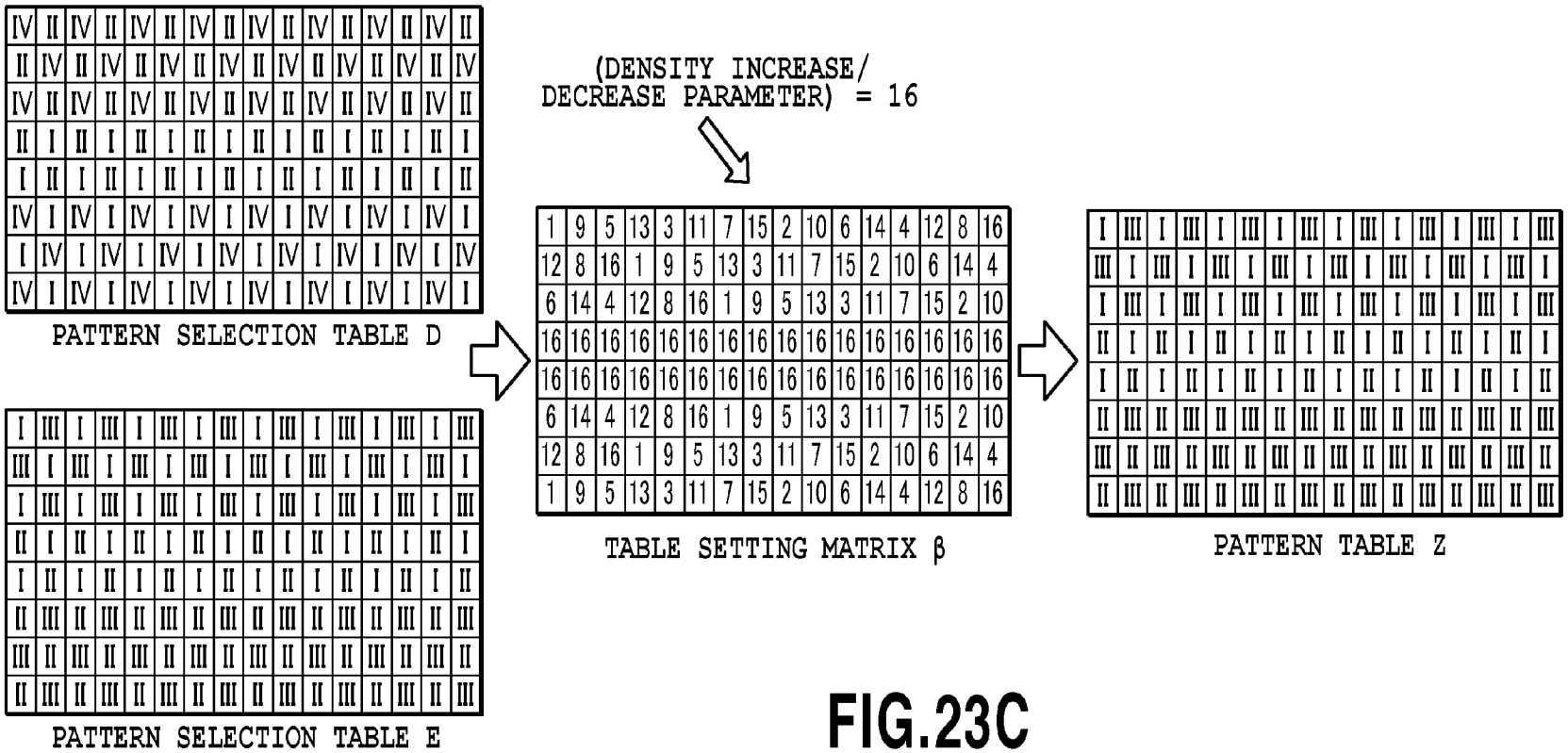

FIGS. 23A to 23C are diagrams each for explaining a pattern table Z used for actual printing, which are generated by using the pattern selection tables D and E and the table setting matrix β shown in FIG. 11 in the case where the density increase/decrease parameters are 0, 8, and 16, respectively.

In the case where the density increase/decrease parameter is 8, the pattern table Z in which the dot arrangement patterns I and II are arranged alternately is generated as shown in FIG.

23A. That is, in the case where the density increase/decrease parameter is 8, correction to add or reduce dots is not performed.

In the case where the density parameter is 0, the dot arrangement pattern IV is allocated to half (48 in total) the pixels in all the pixel rows in the end part regions (three pixel rows at the upper and lower ends) as shown in FIG. 23B. That is, in the case where the density parameter is 0, in the end part regions in the pattern table Z generated by using the pattern selection tables D and E and the table setting matrix β, more dot arrangement patterns IV than those in the end part regions in the pattern table C generated by using the pattern selection tables A and B and the table setting matrix α shown in FIG. 10B are allocated as a result. Because of this, it is possible to perform correction to add more dots compared to the case where the pattern selection tables A and B and the table setting matrix α are used.

Further, in the case where the density parameter is 16, the dot arrangement pattern III is allocated to half (48 in total) the pixels in all the pixel rows in the end part regions (three pixel rows at the upper and lower ends) as shown in FIG. 23C. In other words, in the case where the density parameter is 16, in the end part regions in the pattern table Z generated by using the pattern selection tables D and E and the table setting matrix β, more dot arrangement patterns III than those in the end part regions in the pattern table C generated by using the pattern selection tables A and B and the table setting matrix α shown in FIG. 10C are allocated as a result. Because of this, it is possible to perform correction to reduce more dots compared to the case where the pattern selection tables A and B and the table setting matrix α are used.

After this, a method in that which of the combination of the pattern selection tables A and B and the table setting matrix α and the combination of the pattern selection tables D and E and the table setting matrix β is used is determined in accordance with a variety of printing conditions and printing data (dot printing data) is generated by using the determined combination of the pattern selection tables and the table setting matrix.

First Embodiment

In the first embodiment, a method for making the correction width different in accordance with the kind of ink (in particular, ink lightness) is explained. The degree of the dots spreading or the conspicuity of the joint streak may be different depending on the kind of ink even though the printing medium is the same. In particular, in the case where inks having the same color tone but different in lightness are used, such as cyan and light cyan, and magenta and light magenta, are used at the same time, in many cases, the ink having a high lightness is printed in a high density for all the gradation region compared to the ink having a low lightness and the joint streak is apt to be conspicuous. Then, in this case, the joint streak of the ink having a high lightness is affected not only by dots in the one pixel row at the uppermost end and the lowermost end which sandwich the boundary part but also by dots that are printed in a plurality of pixel rows around the boundary part.

Consequently, in the present embodiment, among the inks in six colors shown in FIG. 2B, for first inks having a comparatively low lightness, such as black, cyan, and magenta, the combination of the pattern selection tables A and B and the table setting matrix α shown in FIG. 7 and FIG. 8 is used. On the other hand, for second inks having a comparatively high lightness, such as light cyan, light magenta, and yellow, the combination of the pattern selection tables D and E and the table setting matrix β shown in FIGS. 11A to 11C is used. Due to this, for the inks having a comparatively low lightness, it is made possible to adjust the addition or reduction of dots in 16 steps in the one-pixel correction widths at the upper and lower ends. For the light cyan, light magenta, and yellow inks having a comparatively high lightness, it is made possible to adjust the addition or reduction of dots in 16 steps in the three-pixel correction widths at the upper and lower ends. In other words, according to the present embodiment, it is possible to perform the addition or reduction of dots by an appropriate amount in an appropriate correction width in accordance with the lightness of the ink, and therefore, it is possible to output a uniform image with no joint streak for all the ink colors.

Second Embodiment

In the second embodiment, a method for making the correction width different in accordance with the kind of printing medium is explained. The degree of dots spreading or conspicuity of the joint streak is different depending on the kind of printing medium. For example, in the case of the printing medium on which ink is comparatively unlikely to blur, such as glossy paper, the diameter of printed dot is small and the number of pixel rows that affect the density of the joint streak is small. In contrast to this, in the case of the printing medium on which ink is comparatively likely to blur, such as plain paper and coated paper, the diameter of printed dot is large and the number of pixel rows that affect the density of the joint streak is large.

Consequently, in the present embodiment, in the case where the printing medium on which ink is comparatively unlikely to blur, such as glossy paper, is used, the pattern table C is acquired from the combination of the pattern selection tables A and B and the table setting matrix α shown in FIG. 7 and FIG. 8. On the other hand, in the case where the printing medium on which ink is comparatively likely to blur, such as plain paper and coated paper, is used, the pattern table C is acquired from the combination of the pattern selection tables D and E and the table setting matrix ρ shown in FIGS. 11A to 11C. Due to this, for the printing medium on which ink is comparatively unlikely to blur, it is possible to adjust the addition or reduction of dots in the one-pixel correction widths at the upper and lower ends in 16 steps so that the white streak or black streak is no longer conspicuous. Further, for the printing medium on which ink is comparatively likely to blur, it is possible to adjust the addition or reduction of dots in the three-pixel correction widths at the upper and lower ends in 16 steps so that the white streak or the black streak is no longer conspicuous. In other words, according to the present embodiment, it is made possible to perform the addition or reduction of dots by an appropriate amount in an appropriate correction width in accordance with the kind of printing medium, and therefore, it is possible to output a uniform image with no joint streak for a variety of printing media.

Third Embodiment

In the third embodiment, the case where the correction width is made different in accordance with the eject amount in a configuration in which a printing head capable of ejecting ink droplets in a variety of eject amounts is used. In recent years, in order to implement high gradation properties, a printing head including an eject port column for printing with large dots and an eject port column for printing with small dots in the same ink color is provided. In this case, the dot diameter of the large dot is larger than that of the small dot, and therefore, the number of pixel rows that affect the density of the joint streak is larger in the case of the large dot.

Consequently, in the present embodiment, for the eject port column for printing with small dots, the pattern table C is acquired from the combination of the pattern selection tables A and B and the table setting matrix α shown in FIG. 7 and FIG. 8. On the other hand, for the eject port column for printing with large dots, the pattern table C is acquired from the combination of the pattern selection tables D and E and the table setting matrix β shown in FIGS. 11A to 11C. Due to this, for the small dots whose range of blurring is narrow, it is made possible to adjust the addition or reduction of dots in the one-pixel correction widths at the upper and lower ends so that the white streak or the black streak is no longer conspicuous. Further, for the large dots whose range of blurring is wide, it is made possible to adjust the addition or reduction of dots in the three-pixel correction widths at the upper and lower ends so that the white streak or the black streak is no longer conspicuous. In other words, according to the present embodiment, it is made possible to perform the addition or reduction of dots by an appropriate amount in an appropriate correction width in accordance with the dot diameter, and therefore, it is made possible to output a uniform image with no joint streak for a variety of dot sizes.

Fourth Embodiment

In the fourth embodiment, a method for making the correction width different in accordance with image data that is input.

Figure 12B:
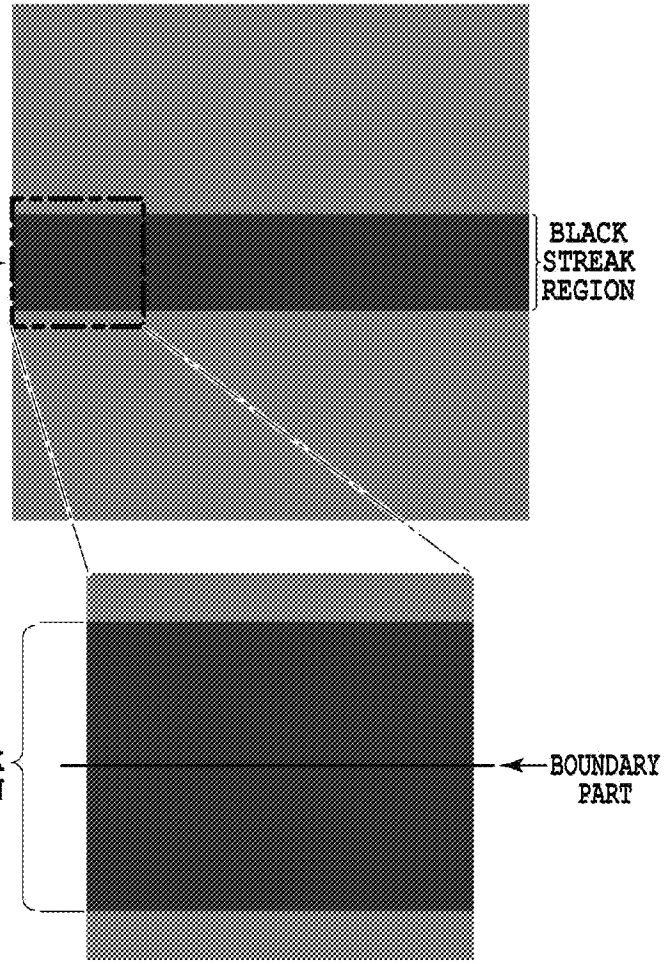
FIGS. 12A and 12B are diagrams showing a dot array and a joint streak occurrence state in the case where the density is about level 1.
Figure 12A:
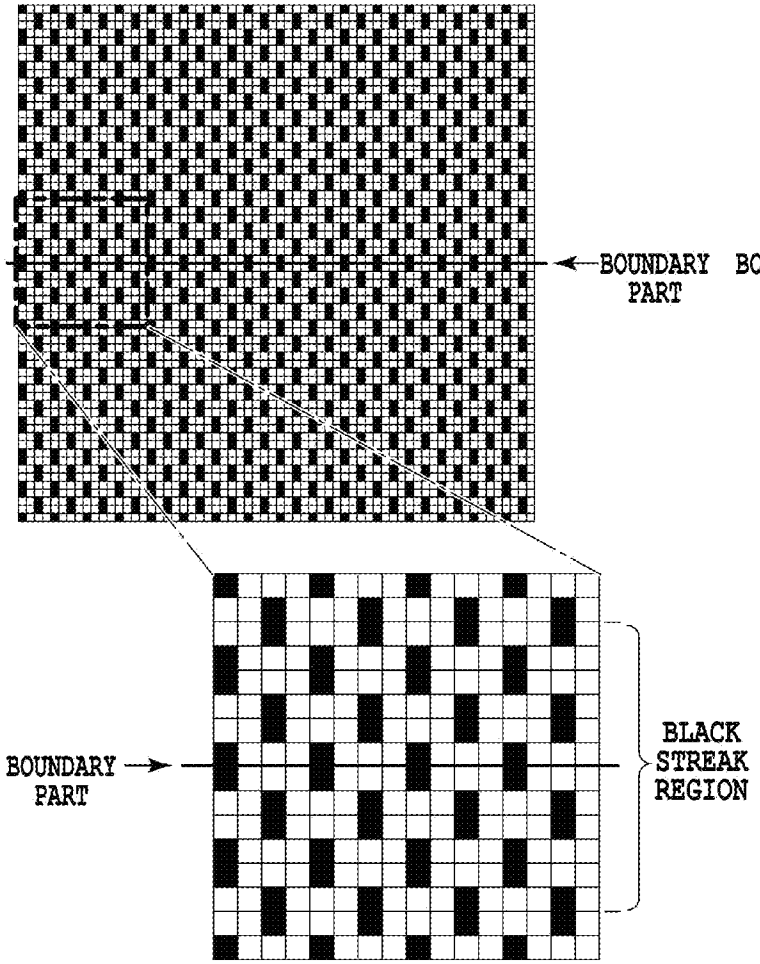

FIGS. 12A and 12B are diagrams showing a dot array and a joint streak conspicuous state in the case where each pixel is at about level 1 in FIG. 5. FIG. 12A shows a dot arrangement pattern in the case where correction processing to reduce the joint streak is not performed and the pattern I and the pattern II at level 1 are arrayed alternately for all the pixels, together with an enlarged view. FIG. 12B shows the black streak that occurs in the case where dots are printed as in FIG. 12A and an enlarged view thereof. Referring to both the enlarged views in FIGS. 12A and 12B, the region that appears as the black streak in this example includes a region corresponding to 12 pixels in 1,200 dpi, i.e., six pixels in 600 dpi, and therefore, for the pattern selection table and the table setting matrix, a correction width of about three pixels is necessary at the upper and lower ends, respectively.

Figure 13B:
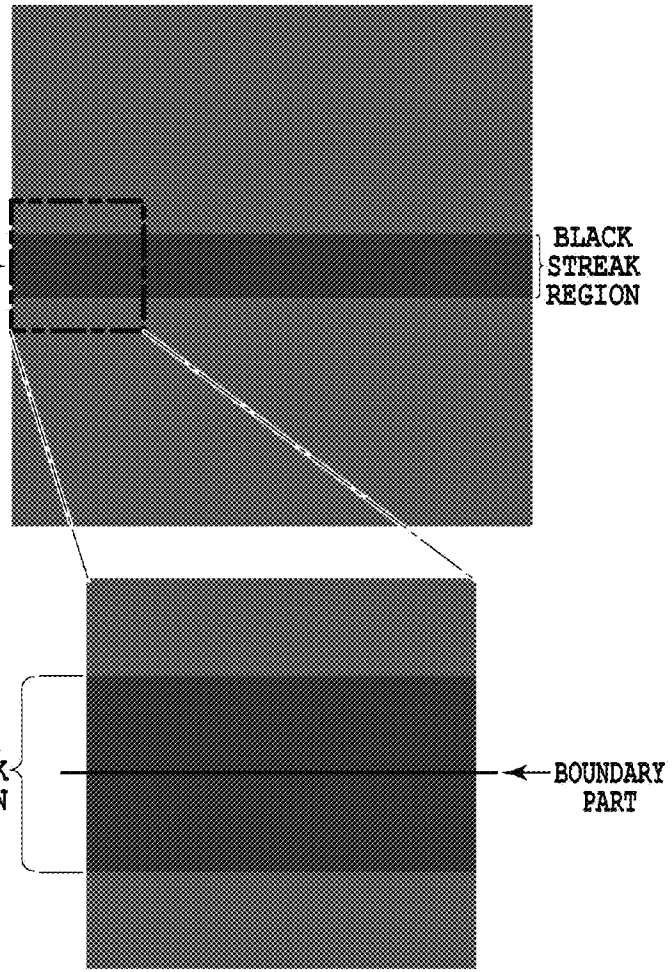
FIGS. 13A and 13B are diagrams showing a dot array and a joint streak occurrence state in the case where the density is about level 2.
Figure 13A:
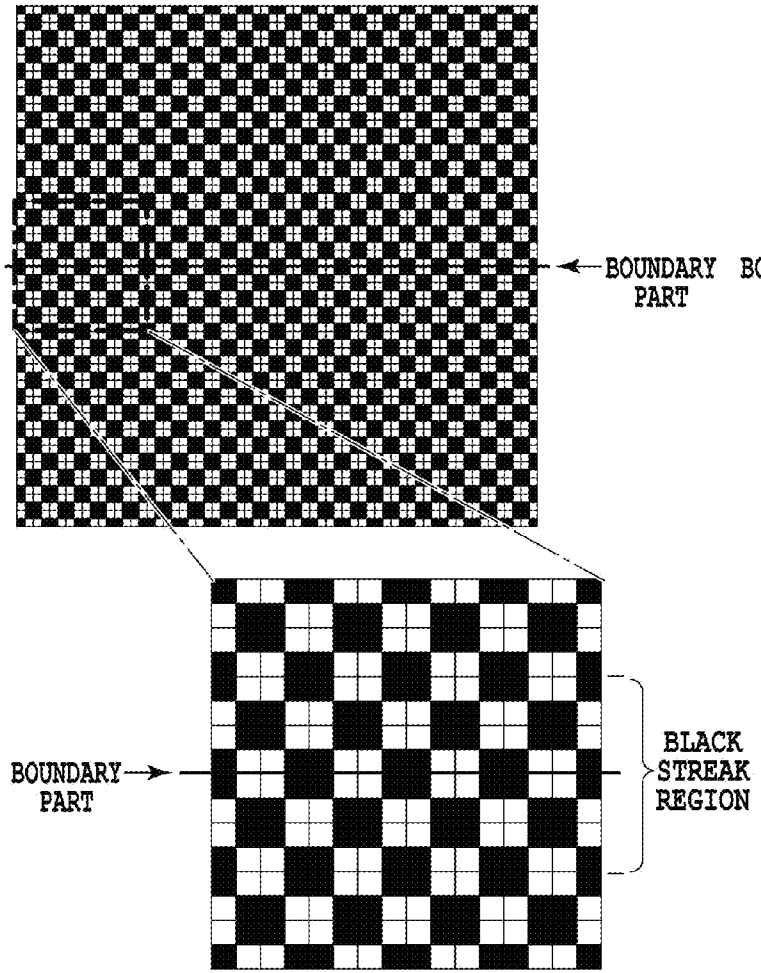

On the other hand, FIGS. 13A and 13B are diagrams showing a dot array and a joint streak occurrence state in the case where each pixel is at about level 2 in FIG. 5, similar to FIGS. 12A and 12B. FIG. 13A shows a dot arrangement pattern in the case where correction processing to reduce the joint streak is not performed and the pattern I and the pattern II at level 2 are arrayed alternately for all the pixels, together with an enlarged view. Referring to the enlarged views in FIGS. 13A and 13B, in this example, the region of the black streak corresponds to eight pixels in 1,200 dpi, i.e., four pixels in 600 dpi, and for the pattern selection table and the table setting matrix, a correction width of about two pixels is necessary at the upper and lower ends, respectively.

In other words, by comparing FIGS. 12A and 12B with FIGS. 13A and 13B, it is known that an appropriate correction width is different between the case where the image density is at about level 1 and the case where the image density is at about level 2. Consequently, in the present embodiment, in accordance with the density data of each color, the combination of the pattern selection table and the table setting matrix used for each eject port column is made different.

FIGS. 14A to 14C are diagrams showing a table setting matrix and pattern selection tables in the case where the correction width is set to two pixels.

In a pattern selection table F shown in FIG. 14A, in the two-pixel width at the upper end, the patterns II and IV are set alternately and in the two-pixel width at the lower end, the patterns I and IV are set alternately. Then, in the four-pixel width at the center except for the two-pixel width at the upper end and the two-pixel width at the lower end, the patterns I and II are set alternately. In the case where the pattern selection table F such as this is used, in the two-pixel widths at the upper and lower ends, respectively, printing is performed with more dots increased by addition than those at the center as a result. In other words, the pattern selection table F will be a table effective in the case where the white streak is conspicuous within the two-pixel width.

On the other hand, in a pattern selection table G shown in FIG. 14B, in the two-pixel width at the upper end, the patterns I and III are set alternately and in the two-pixel width at the lower end, the patterns II and III are set alternately. Then, in the four-pixel width at the center except for the two-pixel width at the upper end the two-pixel width at the lower end, the patterns I and II are set alternately. In the case where the pattern selection table G such as this is used, in the two-pixel widths at the upper and lower ends, respectively, printing is performed with less dots decreased by reduction than those at the center as a result. In other words, the pattern selection table G will be a table effective in the case where the black streak is conspicuous within the two-pixel width.

FIG. 14C is a diagram showing a table setting matrix γ corresponding to the pattern selection tables F and G. To each pixel in each pixel width of the two-pixel widths at the upper and lower ends, one and the different one of parameters 1 to 16 is allocated and to the four-pixel width at the center, 16 is allocated uniformly. It is possible to adjust the addition or reduction of dots within the two-pixel width in 16 steps by setting a dot arrangement pattern in each pixel in accordance with the method explained in FIGS. 10A to 10C by using the combination of the table setting matrix γ and the pattern selection tables F and G.

In the present embodiment, in the case of the density data at about level 1, the pattern table C that is used for printing is acquired from the combination of the pattern selection tables D and E and the table setting matrix β shown in FIGS. 11A to 11C. On the other hand, in the case of the density data at about level 2, the pattern table C that is used for printing is acquired from the combination of the pattern selection tables F and G and the table setting matrix γ shown in FIGS. 14A to 14C. Due to this, for the image of about level 1, wherein the joint streak having a wide range appears, it is made possible to adjust the addition or reduction of dots in the three-pixel correction widths at the upper and lower ends. Further, for the image of about level 2, wherein the joint streak narrower than the above appears, it is made possible to adjust the addition or reduction of dots in the two-pixel correction widths at the upper and lower ends. That is, according to the present embodiment, it is possible to perform the addition or reduction of dots by an appropriate amount in an appropriate correction with in accordance with the density data, and therefore, it is made possible to output a uniform image with no joint streak in variety of gradation regions.

In the above, the case where the correction width is made different between the density data at about level 1 and the density data at about level 2 is explained by using an example in which there are three quantization values. However, it is also possible to increase the number of quantization values, i.e., the number of level values. Even in the case where there are more level values, it is possible to adjust the correction width to an appropriate value both in the case where the level value is a first value and in the case where the level value is a second value greater than the first value.

Fifth Embodiment

In the fifth embodiment, an aspect is explained, in which a transparent ink for facilitating fixing of inks is provided in addition to the inks in six colors shown in FIG. 1. Here, it is assumed that it is possible to switch between use and non-use of the transparent ink in accordance with the kind of printing medium, the quality of printing, etc. In the case where the transparent ink is used, the colored ink is suppressed from blurring on a printing medium, leading to higher color development properties. Then, compared to the case where the transparent ink is not used, the number of pixel rows that affect the density in the boundary region (i.e., the joint streak) is also suppressed.

Consequently, in the present embodiment, even in the case where the printing medium is the same, in the printing mode in which the transparent ink is used, the pattern table C for the colored ink is acquired from the combination of the pattern selection tables A and B and the table setting matrix $\alpha$ shown in FIG. 7 and FIG. 8. On the other hand, in the printing mode in which the transparent ink is not used, the pattern table C for the colored ink is acquired from the combination of the pattern selection tables D and E and the table setting matrix $\beta$ shown in FIGS. 11A to 11C. Due to this, in the case where the transparent ink is used, i.e., where the blurring range is narrow, it is made possible to adjust the addition or reduction of dots in the one-pixel correction widths at the upper and lower ends. In the case where the transparent ink is not used, i.e., where the blurring range is wide, it is made possible to adjust the addition or reduction of dots in the three-pixel correction widths at the upper and lower ends. The printing data of the transparent ink is generated based on the density data of the colored ink etc., but the addition or reduction of dots is not performed for the boundary region in particular.

According to the present embodiment such as this, it is possible to perform the addition or reduction of dots by an appropriate amount in an appropriate correction width in accordance with use/non-use of the transparent ink, and therefore, it is made possible to output a uniform image with no joint streak regardless of the printing mode.

Sixth Embodiment

In the sixth embodiment, a method for correcting the joint streak in the case where the streak is limited to the black streak is explained.

Figure 15:
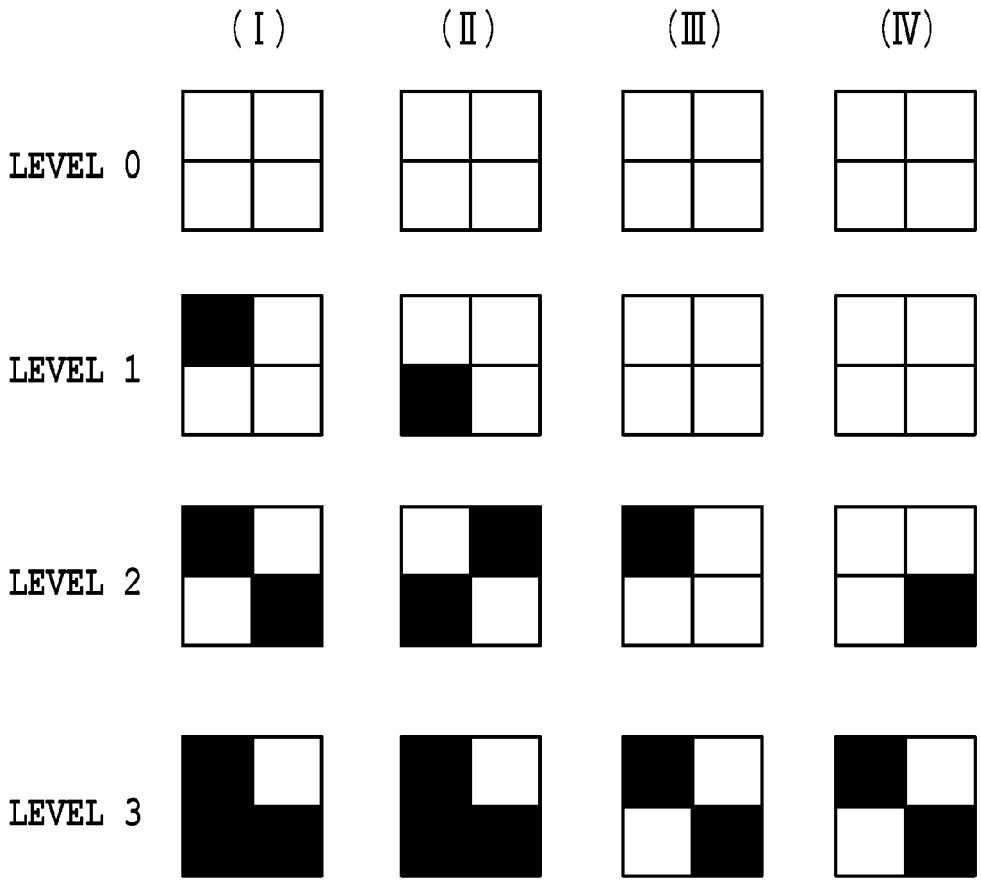
FIG. 15 is a diagram showing dot arrangement patterns I to IV used in a sixth embodiment.

FIG. 15 is a diagram showing the dot arrangement patterns I to IV referred to by the CPU 301. As the dot arrangement patterns shown in FIG. 5, the pattern III whose number of printing pixels is made less than those of the patterns I and II, and the pattern IV whose number of printing pixels is increased are prepared. In the present embodiment in which the joint streak is limited to the black streak, it is not necessary to prepare a pattern to that causes the addition of dots, and therefore, both in the pattern III and in the pattern IV, the number of dots is similarly made less than those of the patterns I and II.

FIGS. 16A and 16B are diagrams showing pattern selection tables A' and B' for dealing with the joint streak used in the present embodiment. In the pattern selection table A' shown in FIG. 16A, in all the pixel regions, the patterns I and II are set alternately. On the other hand, in the pattern selection table B' shown in FIG. 16B, in the one-pixel widths at the upper end and the lower end, the patterns III and IV are set alternately and in the six-pixel width at the center except for the upper end and the lower end, the patterns I and II are set alternately. In the case where the pattern selection table A' is used, dots are not increased or decreased in the boundary region. In the case where the pattern selection table B' is used, dots are reduced in the one-pixel widths at the upper end and at the lower end compared to those at the center. As a table setting matrix corresponding to the pattern selection tables A' and B', it is possible to use the table setting matrix $\alpha$ as in the above-described embodiment.

Figure 17:
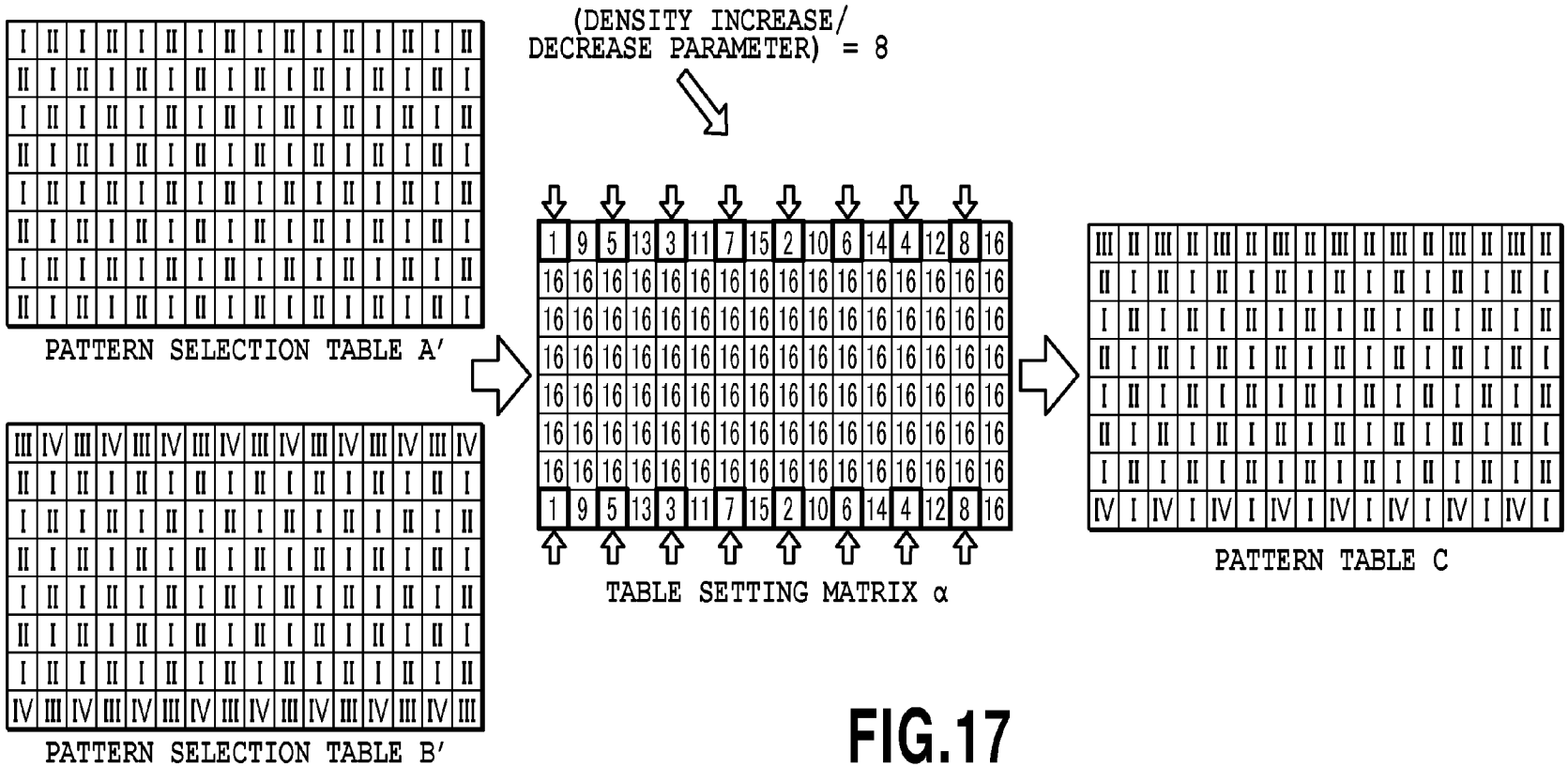
FIG. 17 is a diagram explaining a method for acquiring a pattern table used at the time of printing.

FIG. 17 is a diagram explaining a method for acquiring the pattern table C that is used for actual printing from the pattern selection tables A' and B' and the table setting matrix $\alpha$. Here, the case where the density increase/decrease parameter P is set to "8" is explained.

In the table setting matrix $\alpha$, the parameters in the region except for the pixel rows at the upper and lower ends are uniformly "16", which is larger than the density increase/decrease parameter P="8". Consequently, in this region, the dot arrangement patterns I and II set in the corresponding region of the pattern selection table A' are set exactly as they are. On the other hand, the parameter in the pixel rows at the upper and lower ends of the table setting matrix $\alpha$ is any of "1" to "16" and half the parameters are larger than the density increase/decrease parameter P "8" but the remaining half are equal to or less than the density increase/decrease parameter P="8". Because of this, to this region, the dot arrangement pattern I or II set in the pattern selection table A and the dot arrangement pattern III or IV set in the pattern selection table B are allocated alternately in accordance with the pixel position. As a result of that, in the pattern table C, only in the pixel rows at the upper and lower ends, the dot arrangement pattern III or IV that causes the reduction of dots is arranged.

Then, according to the present embodiment, it is designed so that the closer the density increase/decrease parameter to "16", the more the number of pixels in which the dot arrangement patterns III or IV are set increases in the boundary region and also the more the number of dots that are reduced from the boundary region also increases. In other words, according to the present embodiment, by adjusting the density increase/decrease parameter P in the range of 1 to 16 in accordance with conspicuity of the black streak, it is possible to perform the reduction of dots by an appropriate amount so as to make the black streak no longer conspicuous.

At this time, also in the present embodiment, a plurality of pattern selection tables whose correction width is made different may be prepared, such as the pattern selection tables D and E and the pattern selection tables F and G with respect to the pattern selection tables A and B. Then, by making the correction width different in accordance with a variety of conditions as explained in the first to fourth embodiments, it is made possible to appropriately eliminate the black steak.

Seventh Embodiment

Figure 18:
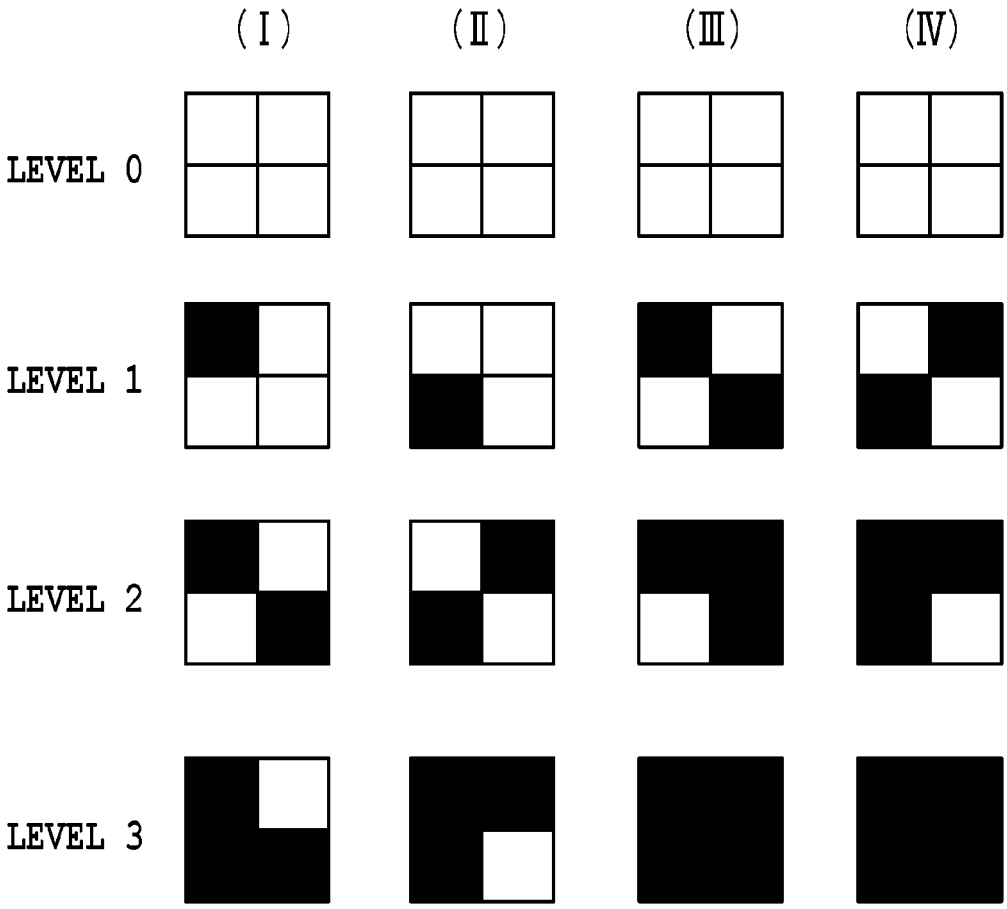
FIG. 18 is a diagram showing dot arrangement patterns I to IV used in a seventh embodiment.

In the seventh embodiment, in contrast to the sixth embodiment, a correction method in the case where the joint streak is limited to the white streak is explained. FIG. 18 is a diagram showing the dot arrangement patterns I to IV referred to by the CPU 301 in the present embodiment. In the present embodiment in which the joint streak is limited to the white streak, it is not necessary to prepare a pattern that caused the reduction of dots, and therefore, in the pattern III and the pattern IV also, the number of dots is increased compared to that of the patterns I and II.

In the case where the dot arrangement patterns such as these are used together with the pattern selection tables A' and B' used in the sixth embodiment, the pattern selection table A' will be a table that does not increase or decrease dots in the boundary region and the pattern selection table B' will be a table that adds dots in the boundary region. Then, by using the dot arrangement patterns shown in FIG. 18 together with the pattern selection tables A' and B' and the table setting matrix α, it is possible to adjust the ratio in which the dot arrangement pattern III or IV is used in the boundary region to an appropriate ratio in accordance with the density increase/decrease parameter. In other words, it is possible to add dots so that the white streak is no longer conspicuous. In the present embodiment also, of course it is made to possible to appropriately eliminate the white streak in accordance with a variety of conditions, such as the lightness of the ink, the kind of printing medium, the size of dot diameter, and the density data, by preparing a plurality of pattern selection tables whose correction width is made different from one another.

Figure 19:
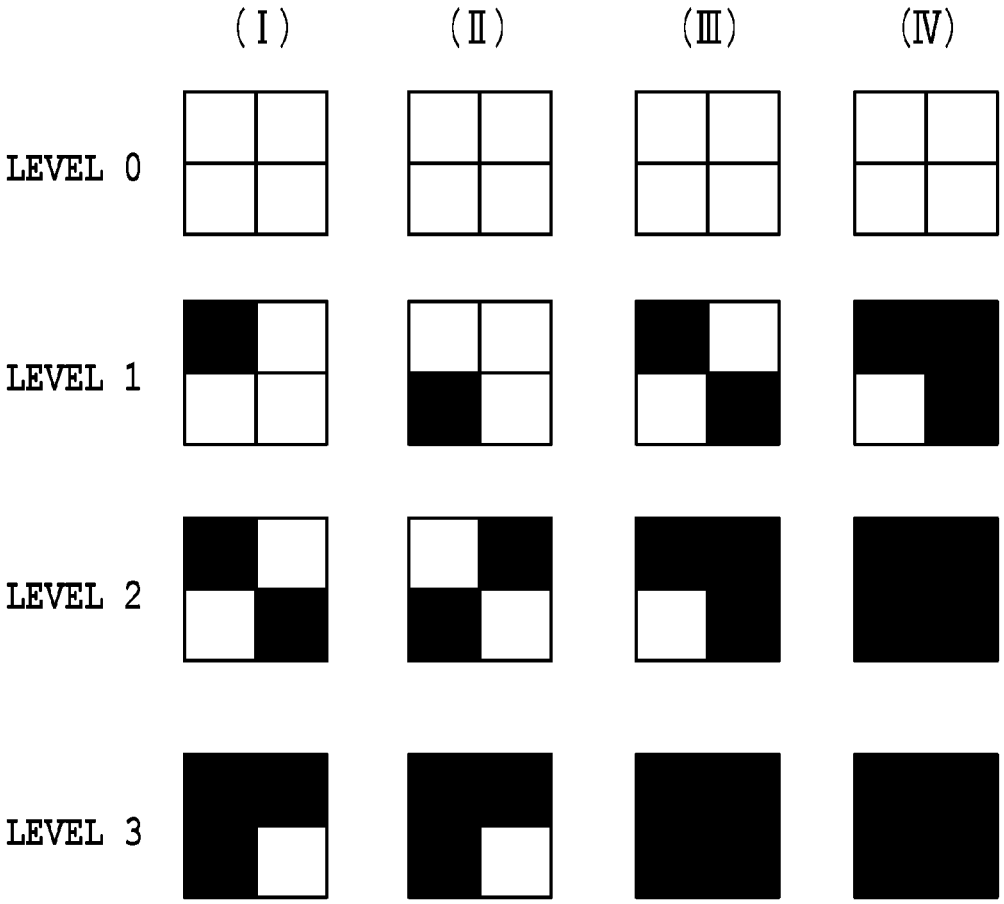
FIG. 19 is a diagram showing modified examples of the dot arrangement patterns I to IV used in the seventh embodiment.

In FIG. 18, the pattern III and the pattern IV are prepared, in which dots in the same number are added to the same level, such as two dots are added in the case of level 1 and three dots are added in the case of level 2, but it may also be possible to prepare the pattern III and the pattern IV in which the numbers of dots that are added are made different as in FIG. 19. In this case, it is possible to set a larger number of dots that are added for correction by increasing the ratio of the number of patterns IV that are arranged in the pixel rows at the upper and lower ends of the pattern selection tables A' and B'.

In the above, explanation is given by using the aspect in which the four kinds of dot arrangement patterns I to IV are prepared, but the present invention is not limited to this aspect. In the above explanation, 2×2 dot arrangement patterns are used in order to convert the three-valued data in 600 dpi into the binary data in 1,200 dpi, but in the case where the output resolution is still higher compared to the input resolution, the number of pixels included in the dot arrangement patterns will also increase accordingly. In this case, it is possible to prepare a larger number of kinds of dot arrangement patterns in which dot array methods or the numbers of dots that are added (or reduced) are made different from one another.

Eighth Embodiment

In the printing scans performed twice successively, the joint streak does not necessarily appear in symmetry with respect to the boundary part as a center. There is a case where the joint streak appears at a position above the boundary part or a case where the joint streak appears at a position below the boundary part. In view of such circumstances, in the present embodiment, a configuration is explained, in which a correction width is set at only one of the upper end and the lower end of the eject port column (i.e., at only one of the upper end and the lower end of the pattern selection table).

FIGS. 20A to 20F are diagrams showing pattern selection tables and table setting matrixes used in the present embodiment. In a pattern selection table H shown in FIG. 20A, in the one-pixel width at the lower end, the patterns I and IV are set alternately and in the other region, the patterns I and II are set alternately. In the case where the pattern selection table H is used together with the dot arrangement patterns shown in FIG. 5, in the one-pixel width at the lower end, printing is performed with more dots increased by addition than those in the other region as a result. On the other hand, in a pattern selection table I shown in FIG. 20B, in the one-pixel width at the lower end, the patterns II and III are set alternately and the in the other region, the patterns I and II are set alternately. In the case where the pattern selection table I such as this is used together with the dot arrangement patterns shown in FIG. 5, in the one-pixel width at the lower end, printing is performed with less dots decreased by reduction than those in the other region as a result.

FIG. 20C is a diagram showing a table setting matrix δ corresponding to the pattern selection tables H and I. To each pixel in the one-pixel width at the lower end, one and the different one of parameters 1 to 16 is allocated randomly and to the other pixel width region, 16 is allocated uniformly. By using the combination of the pattern selection tables H and I and the table setting matrix δ, it is made possible to adjust the addition or reduction of dots in the one-pixel width at the lower end in 16 steps.

On the other hand, pattern selection tables J and K and a table setting matrix ϵ shown in FIGS. 20D to 20F are tables that are made such that correction widths at the lower end of the pattern selection tables H and I and the table setting matrix δ shown in FIGS. 20A to 20C are increased to three pixels. By using the combination of the pattern selection tables J and K and the table setting matrix ϵ, it is made possible to adjust the addition or reduction of dots in the three-pixel width at the lower end in 16 steps. In the present embodiment, by switching the two combinations of the pattern selection tables and the table setting matrix in accordance with the printing conditions, it is made possible to perform the addition or reduction of dots in an appropriate correction width and it is possible to make the joint streak no longer conspicuous.

In the above, the configuration in which the correction width is set at the lower end of the pattern selection table is explained by using the case where the joint streak appears at the position at the lower end of the eject port column as an example, but in the case where the joint streak appears at the position at the upper end of the eject port column, it is sufficient to set the correction width at the upper end of the pattern selection table. FIGS. 21A to 21F are diagrams showing pattern selection tables and table setting matrixes in the case where the correction width is set at the upper end. In the case where the joint streak appears asymmetrically with respect to the boundary part as a center, it is also possible to provide correction widths at both the upper end and the lower end and to make the correction width at the upper end differ from that at the lower end. Anyway, in the case where it is possible to prepare a plurality of combinations of pattern selection tables and a table setting matrix having an appropriate correction width at the upper end part and at the lower end part, respectively, in association with different correction widths, and to switch the combinations in accordance with printing conditions, the joint streak will be reduced effectively.

The parameter array in the correction width region in the table setting matrix is not limited to the aspect explained in the above-described embodiment. In the table setting matrix explained in the above-described embodiment, in the correction width region, one and the different one of 1 to 16 is allocated to each of the 16 pixels arrayed in the X direction and in the Y direction, these parameters are allocated in the state of being shifted in the X direction. However, a matrix that can be adopted in the present invention does not need to be a matrix having such an array. For example, it may also be possible to use a matrix in which parameters 1 to 16 are arranged in the Bayer arrangement in the two-dimensional region of 16 pixels×3 pixels as in FIG. 22. In the matrix in FIG. 22, parameters 1 to 16 are arranged in the Bayer arrangement in the two-dimensional region of 16 pixels×3 pixels, and therefore, the individual parameters are arranged in the highly dispersed state. Further, in place of the Bayer arrangement as in FIG. 22, it is also possible to use a blue noise matrix with less low frequency components. Even in the case where either matrix is used, it is possible to obtain the same effect as that in the above-described embodiment.

In the above-described embodiment, the number of pixels in the Y direction in the pattern selection table and in the table setting matrix is set to the number of pixels equal to the width of the eject port column used in printing, but the size of the pattern selection table and the table setting matrix is not limited to this. However, in the case where a plurality of pattern selection tables is arranged as in FIG. 6, the number of pixels in the Y direction of the pattern selection table and the table setting matrix needs to be an integer multiple of the band region width, i.e., the eject port column width in order to match the correction width with the position of the joint streak.

Further, in the above, the aspect is explained in which a plurality of pattern selection tables and a plurality of table setting matrixes are prepared in advance in correspondence to several correction widths, but the present invention is not limited to the aspect such as this. A configuration may be accepted in which the pattern selection table and the table setting matrix corresponding to the correction width in accordance with the printing conditions are generated at each time of printing.

Furthermore, in the above, explanation is given by premising that the one-pass printing is performed, but the configuration of the present invention can also be adopted even in the case where multi-pass printing is performed. Even in the case of multi-pass printing, the position where the joint streak appears is fixed, and therefore, by preparing pattern selection tables and a table setting matrix whose correction width is matched with such a position and by adjusting the correction width in accordance with the printing conditions, it is possible to obtain the same effect as that in the above-described embodiment.

Still furthermore, in the above, the pattern selection tables and the table setting matrix are used in order to perform the addition or reduction of dots for the limited region in the vicinity of the boundary region, but the present invention is not limited to this. As in Japanese Patent Laid-Open No. 2002-36524 already explained, even in the aspect in which dots of the data after being turned into binary data is counted in the vicinity of the boundary region and the addition or reduction of dots is performed by using a mask pattern etc., it is possible to adopt the processing characteristic to the present invention such that the correction width is changed in accordance with the printing conditions. In this case, for example, it is sufficient to set the correction width in accordance with the lightness of the ink that is used and to perform the addition or reduction of dots by using one of a plurality of mask patterns whose thinning ratio is different from one another for the set correction width.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-265352, filed Dec. 24, 2013, which is hereby incorporated by reference wherein in its entirety.

What is claimed is:

1. An ink jet printing apparatus that prints an image on a printing medium by repeating a printing scan in which an eject port column in which a plurality of eject ports for ejecting ink in accordance with image data is arrayed is moved with respect to the printing medium and a conveyance operation to convey the printing medium in a direction intersecting the direction of the printing scan, the inkjet printing apparatus comprising:

a conveyance control unit configured to control the conveyance operation so that a position where printing is performed by an eject port located at one end part of the eject port column in a first printing scan and a position where printing is performed by an eject port located at the other end part of the eject port column in a second printing scan are adjacent to each other in the direction of the conveyance on the printing medium; and a correction unit configured to perform correction processing for increasing or decreasing the number of times of ink eject for image data corresponding to a first eject port group consisting of a plurality of successive eject ports including the eject port located at the one end part in the first printing scan and for image data corresponding to a second eject port group consisting of a plurality of successive eject ports including the eject port located at the other end part in the second printing scan, wherein the correction unit sets the number of eject ports included in the first eject port group and the number of eject ports included in the second eject port group in accordance with a set printing condition.

2. The ink jet printing apparatus according to claim 1, wherein the printing condition is lightness of ink.

3. The ink jet printing apparatus according to claim 2, wherein in a case where an image is printed by using an eject port column by which a first ink is ejected and an eject port column by which a second ink whose lightness is higher than that of the first ink is ejected, the correction unit sets the number of eject ports included in the first eject port group and the number of eject ports included in the second eject port group so that the number of eject ports included in the first eject port group and in the second eject port group in the eject port column by which the first ink is ejected is smaller than the number of eject ports included in the first eject port group and in the second eject port group in the eject port column by which the second ink is ejected.

4. The ink jet printing apparatus according to claim 1, wherein the printing condition is the kind of the printing medium.

5. The ink jet printing apparatus according to claim 4, wherein the correction unit sets the number of eject ports included in the first eject port group and the number of eject ports included in the second eject port group so that the number of eject ports included in the first eject port group and in the second eject port group in a case where the printing medium is glossy paper is smaller than the number of eject ports included in the first eject port group and in the second eject port group in a case where the printing medium is plain paper or coated paper.

6. The ink jet printing apparatus according to claim 1, wherein the printing condition is the size of the diameter of dots that are formed on the printing medium at the time of the eject of ink.

7. The ink jet printing apparatus according to claim 6, wherein the correction unit sets the number of eject ports included in the first eject port group and the number of eject ports included in the second eject port group so that the number of eject ports included in the first eject port group and in the second eject port group in a case where the dot diameter is a first value is smaller than the number of eject ports included in the first eject port group and in the second eject port group in a case where the dot diameter is a second value greater than the first dot diameter.

8. The ink jet printing apparatus according to claim 1, wherein the printing condition is a level value of an image density.

9. The ink jet printing apparatus according to claim 8, wherein the correction unit sets the number of eject ports included in the first eject port group and the number of eject ports included in the second eject port group so that the number of eject ports included in the first eject port group and in the second eject port group in a case where the level value is a first value is smaller than the number of eject ports included in the first eject port group and in the second eject port group in a case where the level value is a second value smaller than the first value.

10. The ink jet printing apparatus according to claim 1, wherein the printing condition is use or non-use of a transparent ink for facilitating fixing of ink.

11. The ink jet printing apparatus according to claim 10, wherein the correction unit sets the number of eject ports included in the first eject port group and the number of eject ports included in the second eject port group so that the number of eject ports included in the first eject port group and in the second eject port group in a case where the transparent ink is used is smaller than the number of eject ports included in the first eject port group and in the second eject port group in a case where the transparent ink is not used.

12. The ink jet printing apparatus according to claim 1, wherein the correction unit sets the number of eject ports included in the first eject port group and the number of eject ports included in the second eject port group so that the number of eject ports included in the first eject port group and the number of eject ports included in second eject port group are equal.

13. The ink jet printing apparatus according to claim 1, wherein the correction unit sets the number of eject ports included in the first eject port group and the number of eject ports included in the second eject port group so that the number of eject ports included in the first eject port group and the number of eject ports included in second eject port group are different.

14. The ink jet printing apparatus according to claim 1, further comprising a conversion unit configured to convert the image data possessed by each pixel into binary data corresponding to the pixel by using a dot arrangement pattern in which printing or non-printing of dots is determined, wherein the correction unit performs the correction processing by making the dot arrangement pattern used for performing the conversion for the first eject port group and the second eject port group different from the dot arrangement pattern used for performing the conversion for eject ports other than the first eject port group and the second eject port group.

15. An image processing apparatus that performs processing on multivalued image data corresponding to a unit region for printing an image in the unit region including a plurality of pixel regions on a printing medium by a plurality of scans of a an eject port column in which a plurality of eject ports for ejecting ink are arrayed in a predetermined direction with respect to the printing medium, wherein the plurality of eject ports ejects ink to each of the plurality of pixel regions on the printing medium in accordance with dot printing data corresponding to each of the plurality of scans, and by conveying the printing medium between the plurality of scans, the image processing apparatus comprising:

a first acquisition unit configured to acquire information on printing conditions;

a second acquisition unit configured to acquire information on a density of an image that is printed in the pixel region;

a third acquisition unit configured to acquire N (≥3)-valued quantized data corresponding to the pixel region based on the image data;

a fourth acquisition unit configured to acquire a plurality of dot arrangement pattern groups including at least a first dot arrangement pattern group including a plurality of first dot arrangement patterns in which an arrangement of dots is determined so that the number and position of dots that are printed within the pixel region are different in accordance with a value of the N-valued quantized data and a second dot arrangement pattern group including a plurality of second dot arrangement patterns in which an arrangement of dots is determined so that the number and position of dots that are printed within the pixel region are different in accordance with a value of the N-valued quantized data;

a setting unit configured to set one dot arrangement pattern group from the plurality of dot arrangement pattern groups acquired by the fourth acquisition unit in accordance with the positions of the plurality of pixel regions within the unit region; and a generation unit configured to generate the dot printing data based on the N-valued quantized data acquired by the third acquisition unit and the dot arrangement pattern group set by the setting unit, wherein the number of dots that are printed within the pixel region determined by the second dot arrangement pattern corresponding to the N-valued quantized data having a predetermined value is smaller than the number of dots that are printed within the pixel region determined by the first dot arrangement pattern corresponding to the N-valued quantized data having the predetermined value, and the setting unit sets the dot arrangement pattern group so that:

(i) the number of the second dot arrangement pattern groups determined for the plurality of pixel regions located in an end part region corresponding to an end part of the eject port column in the predetermined direction within the unit region in a case where a printing condition indicated by the information acquired by the first acquisition unit is a first printing condition and the density of the image indicated by the information acquired by the second acquisition unit is a first value is smaller than the number of the second dot arrangement pattern groups determined for the plurality of pixel regions located in the end part region in a case where a printing condition indicated by the information acquired by the first acquisition unit is the first printing condition and the density of the image indicated by the information acquired by the second acquisition unit is a second value lower than the first value;

(ii) the number of the second dot arrangement pattern groups determined for the plurality of pixel regions located in the end part region in a case where a printing condition indicated by the information acquired by the first acquisition unit is a second printing condition different from the first printing condition and the density of the image indicated by the information acquired by the second acquisition unit is the first value is smaller than the number of the second dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value; and (iii) the number of the second dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the second value is smaller than the number of the second dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value, and the number of the first dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the second value is larger than the number of the first dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value.

16. The image processing apparatus according to claim 15, wherein the plurality of dot arrangement patterns further includes a third dot arrangement pattern group including a plurality of third dot arrangement patterns in which an arrangement of dots is determined so that the number and position of dots that are printed within the pixel region are different in accordance with a value of the N-valued quantized data, the number of dots that are printed within the pixel region determined by the third dot arrangement pattern corresponding to the N-valued quantized data having the predetermined value is larger than the number of dots that are printed within the pixel region determined by the first dot arrangement pattern corresponding to the N-valued quantized data having the predetermined value, and the setting unit sets the dot arrangement pattern group so that:

(i) the number of the third dot arrangement pattern groups determined for the plurality of pixel regions located in the end part region in a case where a printing condition indicated by the information acquired by the first acquisition unit is a first printing condition and the density of the image indicated by the information acquired by the second acquisition unit is the first value is smaller than the number of the third dot arrangement pattern groups determined for the plurality of pixel regions located in the end part region in a case where a printing condition indicated by the information acquired by the first acquisition unit is the first printing condition and the density of the image indicated by the information acquired by the second acquisition unit is a third value higher than the first value;

(ii) the number of the third dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the first value is smaller than the number of the third dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the third value; and (iii) the number of the third dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the third value is smaller than the number of the third dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the third value.

17. The image processing apparatus according to claim 16, wherein the setting unit sets (i) the dot arrangement pattern group by using a first table in which the first dot arrangement pattern group or the second dot arrangement pattern group is set for each of the plurality of pixel regions within the unit region and a second table in which the first dot arrangement pattern group or the third dot arrangement pattern group is set for each of the plurality of pixel regions within the unit region in a case where a printing condition indicated by the information acquired by the first acquisition unit is the first printing condition, and (ii) the dot arrangement pattern group by using a third table in which the first dot arrangement pattern group or the second dot arrangement pattern group is set for each of the plurality of pixel regions within the unit region and a fourth table in which the first dot arrangement pattern group or the third dot arrangement pattern group is set for each of the plurality of pixel regions within the unit region in a case where a printing condition indicated by the information acquired by the first acquisition unit is the second printing condition, wherein the number of the second dot arrangement pattern groups set in the third table is larger than the number of the second dot arrangement pattern groups set in the first table and the number of the third dot arrangement pattern groups set in the fourth table is larger than the number of the third dot arrangement pattern groups set in the second table.

18. The image processing apparatus according to claim 17, wherein the setting unit:

uses (i) a first threshold value matrix in which a different threshold value is determined for each of the plurality of pixel regions within the unit region in a case where a printing condition indicated by the information acquired by the first acquisition unit is the first printing condition, and (ii) a second threshold value matrix in which a different threshold value is determined for each of the plurality of pixel regions within the unit region in a case where a printing condition indicated by the information acquired by the first acquisition unit is the second printing condition, respectively; and selects the first and third tables, respectively, in a case where the density of an image indicated by the information acquired by the second acquisition unit is lower than a threshold value determined in each of the first and second threshold value matrixes, and selects the second and fourth tables, respectively, in a case where the density of an image indicated by the information acquired by the second acquisition unit is equal to or higher than a threshold value determined in each of the first and second threshold value matrixes.

19. The image processing apparatus according to claim 15, wherein the setting unit sets the dot arrangement pattern so that the number of the second dot arrangement pattern groups determined for the plurality of pixel regions located at a first position in the predetermined direction within the end part region in a case where a printing condition indicated by the information acquired by the first acquisition unit is the first printing condition and the density of the image indicated by the information acquired by the second acquisition unit is a second value is smaller than the number of the second dot arrangement pattern groups determined for the plurality of pixel regions located at a second position closer to the end part of the eject port column than the first position in the predetermined direction within the end part region in a case where a printing condition indicated by the information acquired by the first acquisition unit is the first printing condition and the density of the image indicated by the information acquired by the second acquisition unit is a second value.

20. The image processing apparatus according to claim 15, wherein the first acquisition unit acquires information on lightness of ink that is ejected as information on the printing condition.

21. The image processing apparatus according to claim 15, wherein the first acquisition unit acquires information on the kind of the printing medium as information on the printing condition.

22. An image processing apparatus that performs processing on multivalued image data corresponding to a unit region for printing an image in the unit region including a plurality of pixel regions on a printing medium by a plurality of scans of a an eject port column in which a plurality of eject ports for ejecting ink are arrayed in a predetermined direction with respect to the printing medium, wherein the plurality of eject ports ejects ink to each of the plurality of pixel regions on the printing medium in accordance with dot printing data corresponding to each of the plurality of scans, and by conveying the printing medium between the plurality of scans, the image processing apparatus comprising:

a first acquisition unit configured to acquire information on printing conditions;

a second acquisition unit configured to acquire information on a density of an image that is printed in the pixel region;

a third acquisition unit configured to acquire N (≥3)-valued quantized data corresponding to the pixel region based on the image data;

a fourth acquisition unit configured to acquire a plurality of dot arrangement pattern groups including at least a first dot arrangement pattern group including a plurality of first dot arrangement patterns in which an arrangement of dots is determined so that the number and position of dots that are printed within the pixel region are different in accordance with a value of the N-valued quantized data and a second dot arrangement pattern group including a plurality of second dot arrangement patterns in which an arrangement of dots is determined so that the number and position of dots that are printed within the pixel region are different in accordance with a value of the N-valued quantized data;

a setting unit configured to set one dot arrangement pattern group from the plurality of dot arrangement pattern groups acquired by the fourth acquisition unit in accordance with the positions of the plurality of pixel regions within the unit region; and a generation unit configured to generate the dot printing data based on the N-valued quantized data acquired by the third acquisition unit and the dot arrangement pattern group set by the setting unit, wherein the number of dots that are printed within the pixel region determined by the second dot arrangement pattern corresponding to the N-valued quantized data having a predetermined value is larger than the number of dots that are printed within the pixel region determined by the first dot arrangement pattern corresponding to the N-valued quantized data having the predetermined value, and the setting unit sets the dot arrangement pattern group so that:

(i) the number of the second dot arrangement pattern groups determined for the plurality of pixel regions located in an end part region corresponding to an end part of the eject port column in the predetermined direction within the unit region in a case where a printing condition indicated by the information acquired by the first acquisition unit is a first printing condition and the density of the image indicated by the information acquired by the second acquisition unit is a first value is smaller than the number of the second dot arrangement pattern groups determined for the plurality of pixel regions located in the end part region in a case where a printing condition indicated by the information acquired by the first acquisition unit is the first printing condition and the density of the image indicated by the information acquired by the second acquisition unit is a second value higher than the first value;

(ii) the number of the second dot arrangement pattern groups determined for the plurality of pixel regions located in the end part region in a case where a printing condition indicated by the information acquired by the first acquisition unit is a second printing condition different from the first printing condition and the density of the image indicated by the information acquired by the second acquisition unit is the first value is smaller than the number of the second dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value; and (iii) the number of the second dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the second value is smaller than the number of the second dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value, and the number of the first dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the second value is larger than the number of the first dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the second value.

23. An image processing apparatus that performs processing on multivalued image data corresponding to a unit region for printing an image in the unit region including a plurality of pixel regions on a printing medium by a plurality of scans of a an eject port column in which a plurality of eject ports for ejecting ink are arrayed in a predetermined direction with respect to the printing medium, wherein the plurality of eject ports ejects ink to each of the plurality of pixel regions on the printing medium in accordance with dot printing data corresponding to each of the plurality of scans, and by conveying the printing medium between the plurality of scans, the image processing apparatus comprising:

a first acquisition unit configured to acquire information on printing conditions;

a second acquisition unit configured to acquire information on a density of an image that is printed in the pixel region;

a third acquisition unit configured to acquire N (≥3)-valued quantized data corresponding to the pixel region based on the image data;

a fourth acquisition unit configured to acquire a plurality of dot arrangement pattern groups including at least a first dot arrangement pattern group including a plurality of first dot arrangement patterns in which an arrangement of dots is determined so that the number and position of dots that are printed within the pixel region are different in accordance with a value of the N-valued quantized data and a second dot arrangement pattern group including a plurality of second dot arrangement patterns in which an arrangement of dots is determined so that the number and position of dots that are printed within the pixel region are different in accordance with a value of the N-valued quantized data;

a setting unit configured to set one dot arrangement pattern group from the plurality of dot arrangement pattern groups acquired by the fourth acquisition unit in accordance with the positions of the plurality of pixel regions within the unit region; and a generation unit configured to generate the dot printing data based on the N-valued quantized data acquired by the third acquisition unit and the dot arrangement pattern group set by the setting unit, wherein the number of dots that are printed within the pixel region determined by the second dot arrangement pattern corresponding to the N-valued quantized data having a predetermined value of the first and second dot arrangement pattern groups is smaller than the number of dots that are printed within the pixel region determined by the first dot arrangement pattern corresponding to the N-valued quantized data having the predetermined value, and the setting unit sets the dot arrangement pattern group so that the number of the second dot arrangement pattern groups determined for the plurality of pixel regions located in the end part region in a case where a printing condition indicated by the information acquired by the first acquisition unit is a first printing condition and the density of the image indicated by the information acquired by the second acquisition unit is a predetermined value is smaller than the number of the second dot arrangement pattern groups determined for the plurality of pixel regions located in the end part region in a case where a printing condition indicated by the information acquired by the first acquisition unit is a second printing condition different from the first printing condition and the density of the image indicated by the information acquired by the second acquisition unit is the predetermined value, and the number of the first dot arrangement pattern groups determined for the plurality of pixel regions located in the end part region in a case where a printing condition indicated by the information acquired by the first acquisition unit is the first printing condition and the density of the image indicated by the information acquired by the second acquisition unit is the predetermined value is larger than the number of the first dot arrangement pattern groups determined for the plurality of pixel regions located in the end part region in a case where a printing condition indicated by the information acquired by the first acquisition unit is the second printing condition and the density of the image indicated by the information acquired by the second acquisition unit is the predetermined value.

* * * * *